US005644350A

United States Patent [19]

Ando et al.

[11] Patent Number: 5,644,350

[45] Date of Patent: Jul. 1, 1997

[54] INK JET RECORDING APPARATUS

[75] Inventors: Makoto Ando; Toshiki Kagami, both of Tokyo; Takaaki Murakami, Kanagawa; Masayuki Sato; Noriko Kasahara, both of Tokyo; Kengo Ito, Miyagi; Masanobu Hida, Miyagi; Motohiro Mizumachi, Miyagi, all of Japan

[73] Assignee: Sony Corporation, Japan

[21] Appl. No.: 411,755

[22] PCT Filed: Aug. 1, 1994

[86] PCT No.: PCT/JP94/01263

§ 371 Date: Mar. 30, 1995

§ 102(e) Date: Mar. 30, 1995

[87] PCT Pub. No.: WO95/03940

PCT Pub. Date: Feb. 9, 1995

[30] Foreign Application Priority Data

Jul. 31, 1993 [JP] Japan ..... 5-209008
Dec. 1, 1993 [JP] Japan ..... 5-301359

[51] Int. Cl.[6] ..... B41J 2/01

[52] U.S. Cl. ..... 347/101; 347/96

[58] Field of Search ..... 347/98, 96, 101

[56] References Cited

U.S. PATENT DOCUMENTS 4,538,160 8/1985 Uchiyama ..... 347/98
4,599,627 7/1986 Vollert ..... 347/98

FOREIGN PATENT DOCUMENTS

0587164A3 3/1994 European Pat. Off. .
55-002881 1/1980 Japan .
55-150395 11/1980 Japan .
56-089595 7/1981 Japan .
60-255463 12/1985 Japan .
61-249755 11/1986 Japan .
62-144955 6/1987 Japan .
63-299939 12/1988 Japan .
3027950 2/1991 Japan .
03222749 10/1991 Japan .
3240557 10/1991 Japan .
04048965 2/1992 Japan .

*Primary Examiner*—Valerie Lund
*Attorney, Agent, or Firm*—Ronald P. Kananen

[57] ABSTRACT

An ink jet recording apparatus for expelling an ink from a print head (1) toward a recording medium (2) to form an image thereon has a fixing solution head (10) for forming on the recording medium (2) a dye acceptor layer composed of an intercalation compound which fixes and holds a dye of the ink by way of an intercalation. The fixing solution head (10) expels a solution (fixing solution) containing the intercalation compound. The ink jet recording apparatus is capable of forming images of excellent water resistance and light resistance.

6 Claims, 21 Drawing Sheets

INK JET RECORDING APPARATUS

TECHNICAL FIELD

The present invention relates to an ink jet recording apparatus having a means for forming on a recording medium a dye acceptor layer which fixes and holds a dye by way of an intercalation.

BACKGROUND ART

One of the methods of outputting images such as documents, graphic representations, or the like generated by personal computers or the like onto recording mediums such as sheets of paper, OHP films, or the like is known as an ink jet recording process.

In the ink jet recording process, an ink in the form of a solution is ejected from a nozzle toward a recording medium by a drive source which employs an electric field, heat, pressure, or the like for thereby forming an image on the recording medium. The ink jet recording process is advantageous in that it produces a low level of noise, requires a low running cost, can form images on sheets of ordinary paper, and does not discharge a waste material such as ink ribbons. Therefore, ink jet recording apparatus have been finding widespread use in recent years as recording apparatus for office or personal use.

The ink jet recording process is, however, disadvantageous in that images formed on recording media by this process have poor fixability properties, particularly water resistance and light resistance.

The reasons for such poor fixability properties are as follows: Generally, an ink for use in ink jet recording is composed of a water-soluble dye. For printing using such an ink, the ink is ejected toward a recording medium, and after the ink has been dried, its water-soluble dye remains on the recording medium and is held thereon by the van der Waals forces or hydrogen bonding for thereby fixing an image to the recording medium. Therefore, when a solvent such as water or the like which has a large affinity for the water-soluble dye is supplied to the recorded image, the dye is eluted, causing the image to blur.

The dye also moves, causing the image to blur, when the water-soluble dye which forms the image on the recording medium is supplied with thermal or light energy that is large enough to cancel out the van der Waals forces or hydrogen bonding between the dye and the recording medium. Furthermore, upon exposure of the dye which forms the image to light such as ultraviolet radiation or the like, the molecules of the dye itself are destroyed, causing the image to be faded, discolored, or lowered in density. Therefore, images formed by the dye are also of low light resistance.

The water resistance of images formed according to the ink jet recording process can be improved by using a recording medium of sized paper or a recording medium coated with a resin. The resin to be coated on the recording medium comprises a hydrophilic resin for allowing an image to be formed by a water-soluble dye. Attempts have also been made to improve the light resistance of images formed according to the ink Jet recording process by selecting a dye having a certain basic skeleton or introducing a certain substituent group into a side chain of dye molecules thereby to limit the molecular structure of the dye.

If the recording medium of sized paper is used to improve the water resistance of images formed according to the ink jet recording process, then it takes a long time to fix the ink to the recording medium as the recording medium has low ink absorption.

If the recording medium coated with a hydrophilic resin is used, then it has good ink absorption, but tends to form ink dots of large diameter or ink dots having blurred edges. Since the resin coated on the recording medium is hydrophilic, it essentially is not sufficiently effective to improve the water resistance of recorded images. Another problem of the recording medium coated with a hydrophilic resin is that it impairs the basic advantage of the ink jet recording process that sheets of ordinary paper can be used as the recording medium.

The attempts to limit the molecular structure of the dye for improved light resistance have not yet been sufficiently effective.

The present invention has been made to solve the above problems of the prior art.

It is an object of the present invention to form images of high water and light resistance on sheets of ordinary paper according to an ink jet recording process.

DISCLOSURE OF THE INVENTION

The inventor has found that in order to achieve the above object, a dye acceptor layer composed of an intercalation compound for holding a dye by way of an intercalation may be formed on a recording medium such as of plain paper, that a means for forming such a dye acceptor layer may be included in an ink jet recording apparatus, that the dye acceptor layer may be formed by expelling or spraying a solution (hereinafter referred to as a fixing solution) containing such an intercalation compound from a nozzle or nozzles, or coating a fixing solution on the recording medium with a coating roller, or electrostatically applying a powder (referred to as a clay powder in this specification) composed of an intercalation compound and a thermoplastic resin to the recording medium, or producing a ribbon having a dye acceptor layer composed of an intercalation compound and formed on a base film and thermally transferring the dye acceptor layer of the ribbon onto the recording medium, or melting a fixing agent which is composed of an intercalation compound and a wax and solid at normal temperature (hereinafter referred to as a solid fixing agent) and coating the melted fixing agent on the recording medium, and has completed the present invention.

According to the present invention, an ink jet recording apparatus having an ink nozzle for expelling an ink toward a recording medium to form an image thereon is characterized by a dye acceptor layer forming means for forming on said recording medium a dye acceptor layer composed of an intercalation compound which fixes and holds a dye of the ink by way of an intercalation.

The ink jet recording apparatus according the present invention will hereinafter be described in detail.

In the ink jet recording apparatus according the present invention, an image is fixed on the basis of the formation of an ionic bond caused by an intercalation between a dye in the ink and the intercalation compound of the dye acceptor layer.

The ink may be prepared by dissolving a dye into an aqueous solvent such as water or the like, and adding, if necessary, a viscosity modifier, a surface tension modifier, a drying inhibitor, and so on to the solution. Any of the various inks that have conventionally been used for an ink jet recording apparatus may be used.

An acid dye, a direct dye, a basic dye, or the like may be used without any particular limitations as the dye to be contained in the ink insofar as it can be intercalated into the intercalation compound. For example, a basic dye such as an azo dye having an amine salt or a quaternary ammonium group, a triphenylmethane dye, an azone dye, an oxazine dye, a thiazine dye, or the like may be used. More specifically, a yellow dye such as C.I. basic yellow 1, C.I. basic yellow 2, C.I. basic yellow 11, C.I. basic yellow 13, C.I. basic yellow 14, C.I. basic yellow 19, C.I. basic yellow 21, C.I. basic yellow 25, C.I. basic yellow 28, or C.I. basic yellow 32~36; a magenta dye such as C.I. basic red 1, C.I. basic red 2, C.I. basic red 9, C.I. basic red 12~15, C.I. basic red 17, C.I. basic red 18, C.I. basic red 22~24, C.I. basic red 27, C.I. basic red 29, C.I. basic red 32, C.I. basic red 38~40; C.I. basic violet 7, C.I. basic violet 10, C.I. basic violet 15, C.I. basic violet 21, C.I. basic violet 25~28; a cyan dye such as C.I. basic blue 1, C.I. basic blue 3, C.I. basic blue 5, C.I. basic blue 7, C.I. basic blue 9, C.I. basic blue 19, C.I. basic blue 21, C.I. basic blue 22, C.I. basic blue 24~26, C.I. basic blue 28, C.I. basic blue 29, C.I. basic blue 40, C.I. basic blue 41, C.I. basic blue 44, C.I. basic blue 45, C.I. basic blue 47, C.I. basic blue 54, C.I. basic blue 58~60, C.I. basic blue 64~68, or C.I. basic blue 75; and a black dye such as C.I. basic black 2, or C.I. basic black 8 may be used.

The dye acceptor layer to be formed on the recording medium in order to fix the above dye should preferably be composed of a high-polymer organic intercalation compound having exchangeable negative ions between layers if the ink is composed of an acid dye or a direct dye, or a high-polymer organic intercalation compound having exchangeable positive ions between layers if the ink is composed of a basic dye.

The intercalation compound has a laminar structure and holds interlaminar water and exchangeable ions between layers. The high-polymer inorganic intercalation compound having exchangeable positive ions between layers which is used if the ink is composed of a basic dye may be natural or synthetic laminar silicate or their sintered material. Typically, it is preferable to use a montmorillonite-group mineral which is a clay mineral having a 3-octahedral smectite structure and represented by the following formula (1):

$$(X, Y)_{2\text{-}3}Z_4(_{10}(OH_2)\cdot mH_2O\cdot(W_{1/3}) \quad (1)$$

where X represents Al, Fe(III), Mn(III), or Co(III), Y represents Mg, Fe(II), Ni, Zn, or Li, Z represents Si or Al, W represents K, Na, or Ca, $H_2O$ represents interlaminar water, and m represents an integer.

Depending on the combination of X and Y and the number of substitutions, the montmorillonite-group mineral may be a natural or synthetic mineral such as montmorillonite, magnesia montmorillonite, iron montmorillonite, iron magnesia montmorillonite, beidellite, aluminianbeidellite, nontronite, aluminiannontronite, saponite, aluminiansaponite, hectorite, sauconite, or the like. Materials represented by the above formula (1) with the OH group replaced with fluorine may also be used.

Other than the montmorillonite-group mineral represented by the above formula (1), a mice-group mineral such as sodium silicic mica, sodium teniorite, lithium teniorite, or the like may also be used as an intercalation compound.

The high-polymer inorganic intercalation compound having exchangeable negative ions between layers which is used if the ink is composed of an acid dye or a direct dye may be hydrotalcite or the like.

Depending on the type of the ink used, the dye acceptor layer to be formed on the recording medium may contain an intercalation compound having exchangeable positive ions, such as montmorillonite or the like, or an intercalation compound having exchangeable negative ions, such as hydrotalcite or the like, or both of these intercalation compounds.

The present invention is not limited to any method of forming a dye acceptor layer composed of such an intercalation compound. In an example of such a method, a fixing solution, i.e., a solution containing an intercalation compound, is prepared, and ejected from a solution nozzle onto a recording medium to form a dye acceptor layer.

The fixing solution may be expelled from the solution nozzle as droplets having the same shape as ink droplets expelled from ink nozzles, or may be atomized and expelled (sprayed) from the solution nozzle.

Specifically, the solution nozzle may comprise a single nozzle, and the fixing solution may be sprayed from the nozzle in a range covering an image that will be formed by expelling the ink from the ink nozzles onto the recording medium.

Alternatively, the solution nozzle may comprise an array of nozzles, and fixing solution may be sprayed from the nozzles in a range of an image that will be formed by expelling the ink from the ink nozzles onto the recording medium. If the ink nozzle comprises a plurality of nozzles arranged in the same manner as the nozzles of the solution nozzle, then the nozzles of the solution nozzle are selectively operable to spray the fixing solution in a manner to correspond to those of the nozzles of the ink nozzle which expel the ink.

The solution nozzle may also comprise a nozzle in the form of an oblong hole for spraying the fixing solution in a range covering an image that will be formed by expelling the ink from the ink nozzles onto the recording medium.

The fixing solution may be prepared by mixing an intercalation compound with an aqueous solvent such as water, alcohol, or the like, and adding, if necessary, an additive such as a binder resin, a dispersion stabilizer, an ultraviolet light absorber, or a fluorescent brightener.

Alternatively, a powder (clay powder) composed of an intercalation compound and a thermoplastic resin may be prepared, and a dye acceptor layer may be formed on the recording medium using such a clay powder.

The clay powder may be prepared by dispersing a powdery intercalation compound into a thermoplastic resin binder, and converting the dispersion into a fine powder. The thermoplastic resin binder into which the powdery intercalation compound is to be dispersed may be composed of a stylene - acryl copolymer, polyester, an epoxy resin, or the like, for example.

As the thermoplastic resin to be used as the binder resin, it is preferable not to contain a group which will impair an intercalation between an intercalation compound and a dye, e.g., an ammonium group or the like which is more likely held between layers than the dye.

Since use of a certain intercalation compound and a certain binder resin in combination makes it possible to produce a highly transparent dye acceptor layer, the intercalation compound and the binder resin should be selected depending on the degree of transparency which is required by the recording medium after an image has been formed thereon.

A dye acceptor layer may be formed on a recording medium using a clay powder in the same manner as a toner is applied to a recording medium to form an image thereon according to the electrophotographic process. Specifically, the clay powder may be electrostatically attracted to the recording medium, and then heated so as to be fixed to the recording medium. Alternatively, a clay powder may be dispersed in an insulating solvent such as of dibutyl phthalate or the like, thus producing a clay liquid, and the clay liquid may be attracted to a recording medium in the same manner as a liquid toner image is developed according to the electrophotographic process, for thereby forming a dye acceptor layer.

A dye acceptor layer composed of an intercalation compound may be formed on a recording medium by producing a ribbon having a dye acceptor layer composed of an intercalation compound and a binder resin and formed on a base film made of polyethylene terephthalate or the like, and thermally transferring the dye acceptor layer of the ribbon onto the recording medium.

To the dye acceptor layer of the ribbon, there may be added a plasticizer for controlling the glass transition point Tg thereof unless it does not impair the transferability thereof to the recording medium. Furthermore, an additive for controlling the water repellancy, an ultraviolet light absorber for improving the light resistance, a fluorescent brightener, and so forth may also be added. In the production of the ribbon, because use of a certain intercalation compound and a certain binder resin in combination makes it possible to produce a highly transparent dye acceptor layer, the intercalation compound and the binder resin should be selected depending on the degree of transparency which is required by the recording medium after an image has been formed thereon.

If the dye acceptor layer is thermally transferred from the ribbon to form the dye acceptor layer on the recording medium, then the recording medium should preferably be of such a nature as to be prevented from being deformed with the heat when the dye acceptor layer is thermally transferred thereonto.

A dye acceptor layer composed of an intercalation compound may also be formed on a recording medium by preparing a fixing agent which is composed of an intercalation compound and a wax and solid at normal temperature (solid fixing agent) and coating the melted fixing agent on the recording medium. The wax which serves as a binder for the intercalation compound may be carnauba wax, paraffin wax, high-polymer polyethylene glycol, or the like, for example.

In the preparation of a solid fixing solution from a wax and an intercalation compound, depending on the type of the wax used, the ability of the produced solid fixing solution to absorb the ink would be lowered if the proportion of the wax were too high, and the solid fixing agent would not be solid at normal temperature if the proportion of the wax were too low. Therefore, the ratios of the wax and the intercalation compound are determined such that the produced solid fixing solution can well absorb the ink and become solid at normal temperature. For example, if a solid fixing agent is prepared from carnauba wax and synthetic smectite whose ratios are 1:1, then the produced solid fixing solution is hydrophilic and has a good ability to absorb an aqueous ink. Increasing the ratio of the carnauba wax makes the solid fixing agent more hydrophilic. The solid fixing solution can be obtained at room temperature with a ratio of the carnauba wax and synthetic smectite up to about 1:5. If a solid fixing agent is prepared from high-polymer polyethylene glycol and synthetic smectite, then the ability of the produced solid fixing solution to absorb the ink is not reduced by an increase in the proportion of the high-polymer polyethylene glycol.

In the ink jet recording apparatus according to the present invention, an ink is expelled from the ink nozzles to form an image on the recording medium, and a dye acceptor layer composed of an intercalation compound is formed on the recording medium by the dye acceptor layer forming means.

When the ink image is formed on the dye acceptor layer which is formed on the recording medium by the dye acceptor layer forming means or the dye acceptor layer is formed on the ink image by the dye acceptor layer forming means, dye ions in the ink are transferred, together with water and alcohol in the ink, between layers of the intercalation compound of the dye acceptor layer, and exchanged (intercalated) with interlaminar ions that have been present between the layers, so that the dye ions are firmly held between the layers by an ionic bond with the intercalation compound.

The dye thus held between the layers will not be eluted even when supplied with water or the like. Consequently, the image produced by the ink jet recording apparatus according to the present invention has increased water resistance. The dye trapped between the layers is not directly exposed to external light, and hence the light resistance of the image formed by the ink jet recording apparatus according to the present invention is highly increased.

A highly transparent dye acceptor layer can be formed on a recording medium if a certain intercalation compound and a certain binder resin are used in combination. Therefore, a preferable image can be formed on a recording medium that is required to be transparent for OHP use, for example.

BEST MODE FOR CARRYING OUT THE INVENTION

Figure 1:
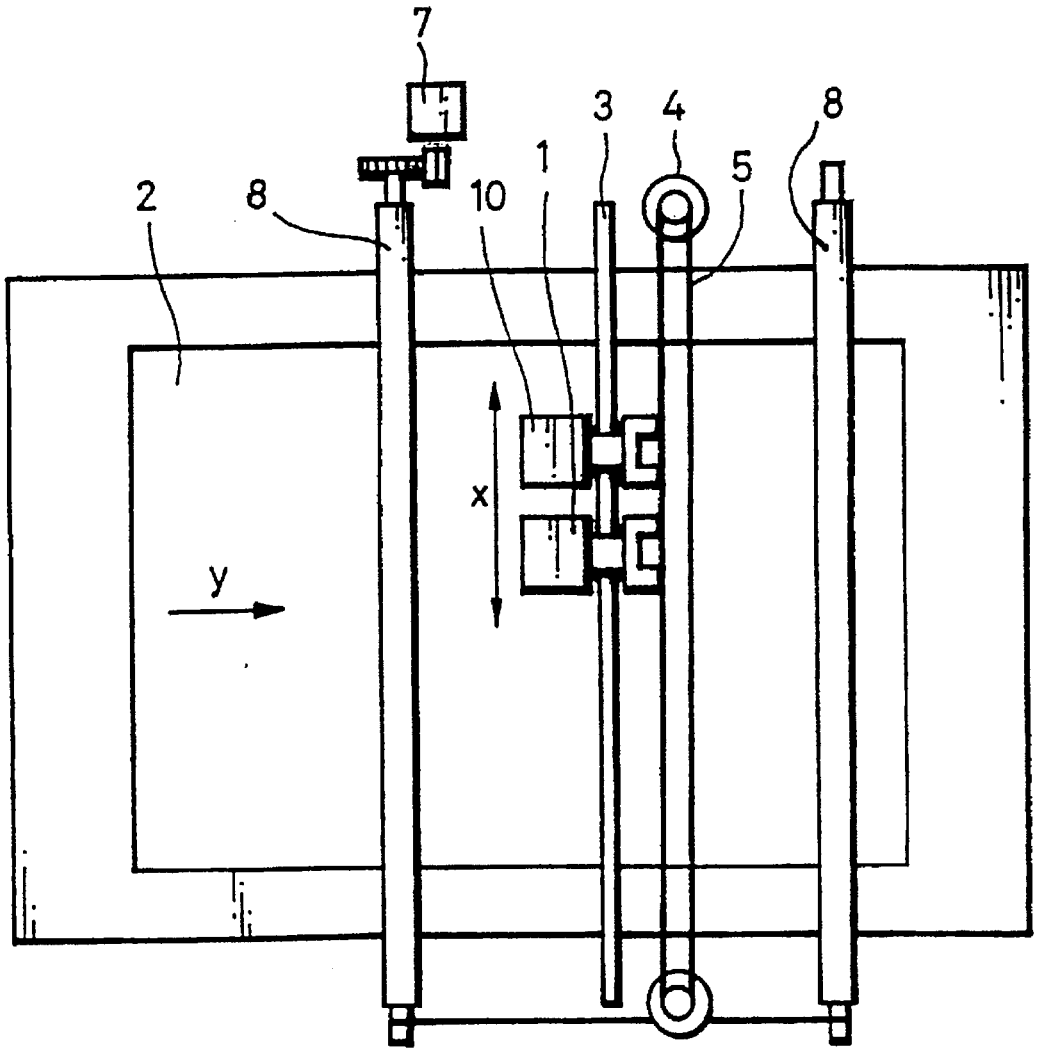
FIG. 1 is a view showing in its entirety an ink jet recording apparatus according to an embodiment of the present invention.

Embodiments of the present invention will hereinafter be described in specific detail with reference to the drawings. Identical reference characters denote identical or equivalent components throughout views.

Figure 2:
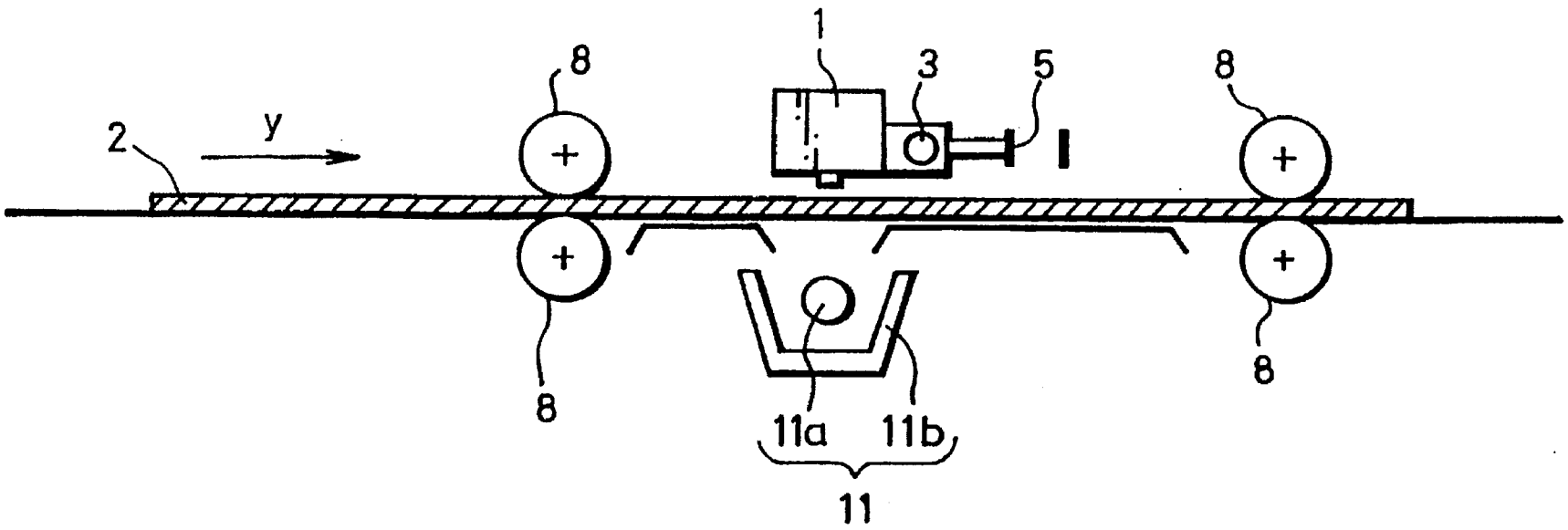
FIG. 2 is a cross-sectional view of a portion in the vicinity of heads of the ink jet recording apparatus according to the embodiment shown in FIG. 1.
Figure 3:
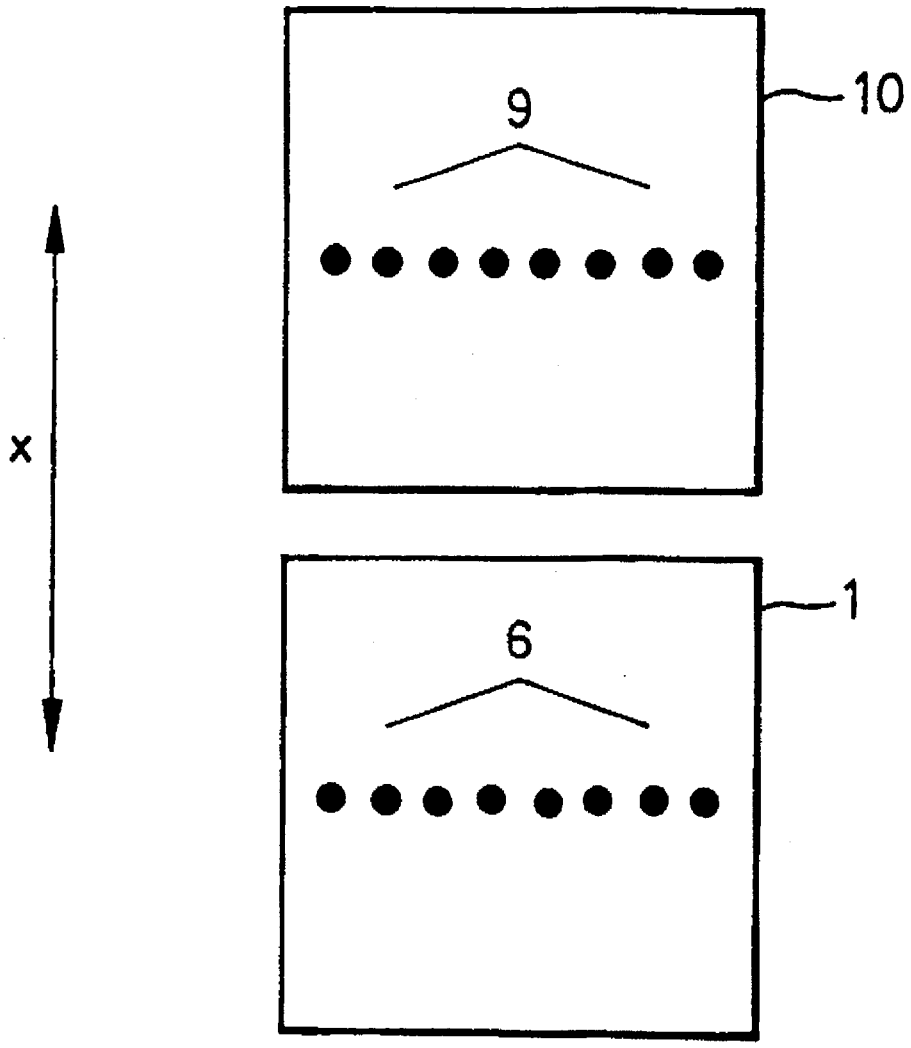
FIG. 3 is a view illustrative of ink nozzles of the heads of the ink jet recording apparatus according to the embodiment shown in FIG. 1.

FIG. 1 is a view showing in its entirety an ink jet recording apparatus according to an embodiment of the present invention, the ink jet recording apparatus comprising a so-called serial ink jet printer having a dye acceptor layer forming means for discharging a fixing solution L to form a dye acceptor layer. FIG. 2 is a view of a portion in the vicinity of heads of the recording apparatus shown in FIG. 1, as viewed in cross section. FIG. 3 is a view illustrative of ink nozzles of the heads of the ink jet recording apparatus.

In the serial ink jet printer, as shown in FIGS. 1 and 2, a print head 1 having ink nozzles 6 (see FIG. 3) for expelling an ink is reciprocally scanned in the transverse direction (indicated by the arrow x) of a recording medium 2 of paper, plastic film, cloth, or the like while the recording medium 2 is being fed in the direction indicated by the arrow y, for thereby printing an image on the recording medium 2.

The print head 1 is supported on a shaft 3 and caused to scan the recording medium by a belt 5 which is trained around a head feed motor 4. The print head 1 may be of the type which produces an ink expelling pressure by either deforming a so-called piezoelectric element, or boiling an ink with a heating element, or using an electric field. As shown in FIG. 3, the print head 1 has an array of ink nozzles 6 perpendicular to the scanning direction thereof.

While the print head 1 usually has such a plurality of ink nozzles, it may have a single nozzle.

The recording medium 2 is fed by a sheet feed roller 8 which is rotated by a sheet feed motor 7.

In this embodiment, the serial ink jet printer has a fixing solution head 10 movable in the scanning direction of the print head 1, the fixing solution head 10 having fixing solution nozzles 9 for expelling a fixing solution L to form a dye acceptor layer. The fixing solution nozzles 9 are located in positional one-to-one correspondence to the ink nozzles 6.

The fixing solution head 10 is arranged to expel, from the fixing solution nozzles 9, droplets of the fixing solution L which are of substantially the same shape as ink droplets (having a diameter ranging from 30 to 100 μm, for example) that are expelled from the ink head 1.

The serial ink jet printer includes a heater 11 disposed on one side of the recording medium 2 opposite to the fixing solution head 10 and the print head 1 and serving as a drying means for drying the fixing solution L expelled from the fixing solution head 10 and the ink expelled from the print head 1. The heater 11 comprises a lamp 11*a* and a reflecting plate 11*b*. The drying means may not necessarily be required in this embodiment, but may be employed if necessary when the rate at which the fixing solution L and the ink dry is too low. In FIG. 2, the drying means is positioned such that the heater 11 is disposed directly below the print head 1. However, the heater 11 may not necessarily be disposed directly below the print head 1.

The recording apparatus according to this embodiment is used as follows: An ink is prepared by mixing 2 parts by weight of a basic dye, 2 parts by weight of glycerin, 6 parts by weight of diethylene glycol, and 30 parts by weight of water. A fixing solution L is prepared by charging 90 g of montmorillonite into 850 g of an ethanol solvent which contains 10 g of polyvinyl butyral, dispersing the montmorillonite into the ethanol solvent for one day, and then mixing 50 g of an ethanol solvent which contains 10 g of glycerin into the dispersion. The ink and the fixing solution L are then set in the recording apparatus. For printing, droplets of the fixing solution L which are of substantially the same diameter as the fixing solution nozzles 9 of the fixing solution head 10 are expelled from the fixing solution nozzles 9 to print a desired character or a graphic representation on the recording medium or to print a solid blank pattern on the recording medium. The fixing solution L permeates the fibers of the recording medium 2 which may be made of paper or the like, and is dried, whereupon the montmorillonite contained in the fixing solution L is attached nearly to the surface of the recording medium 2.

Figure 4:
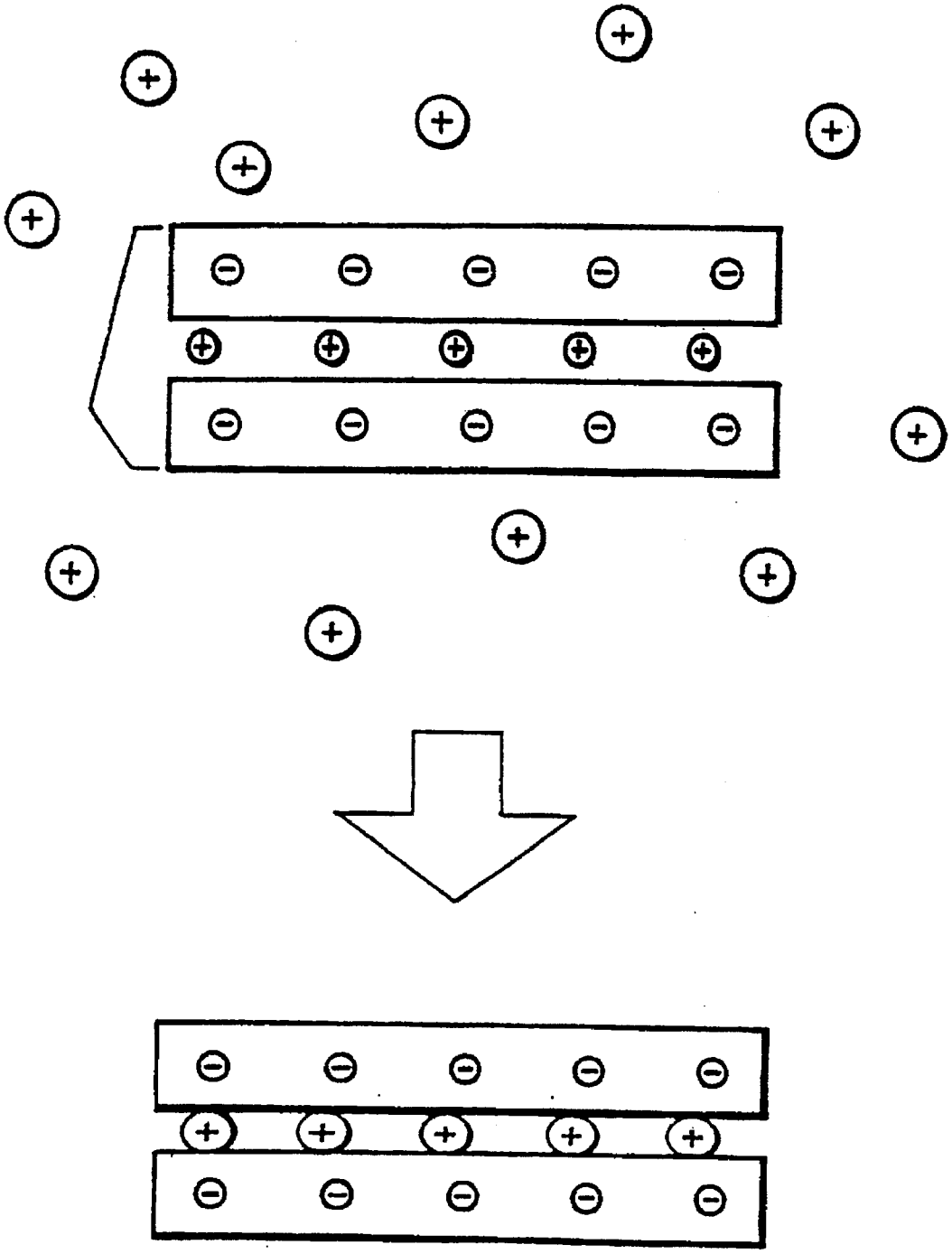
FIG. 4 is a view illustrative of an intercalation.

Then, droplets of the ink which are of substantially the same diameter as the ink nozzles 6 of the print head 1 are expelled from the ink nozzles 6 to print a desired character or a graphic representation on the recording medium. As shown in FIG. 4, the basic dye contained as dye ions in the ink and the water as a solvent are quickly transferred between layers of the montmorillonite as an intercalation compound, and an exchange between dye cations (dye ions) and intercalation positive ions (intercalation ions), i.e., an intercalation, occurs, causing the dye to be trapped between the layers of the montmorillonite. The dye trapped between the layers of the montmorillonite is combined with the montmorillonite by an ionic bond, resulting in a chemically highly stable state.

Figure 5:
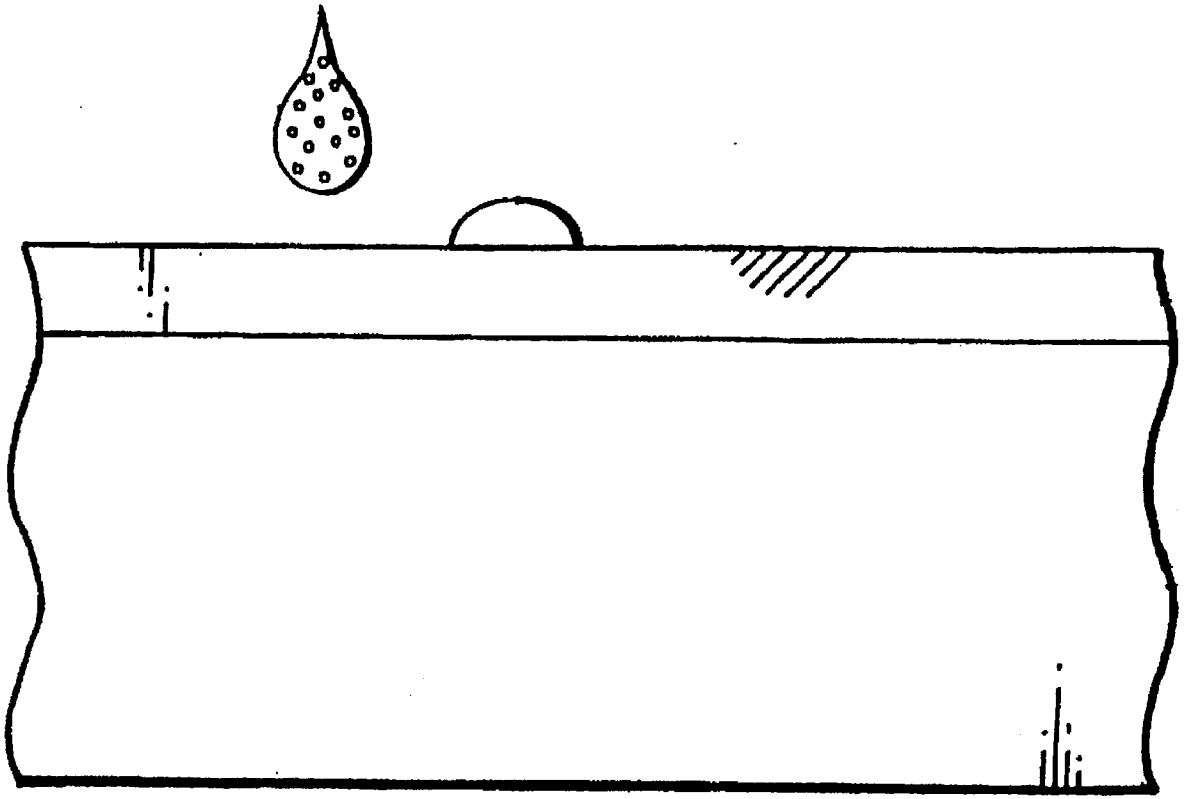
FIG. 5 is a view showing the manner in which an ink is fixed and held by way of an intercalation.

FIG. 5 is a cross-sectional view of the recording medium 2, showing the manner in which printing is carried out by fixing and holding the ink as described above. On the surface of the recording medium 2, there is formed a dye acceptor layer composed of the intercalation compound by the fixing solution. When droplets of an ink (ink droplets) are supplied and attached to the dye acceptor layer, the ink droplets enter between the layers of the intercalation compound by way of an intercalation.

Therefore, the attached dye is prevented from being eluted from or swelling between the layers in the presence of water or a organic solvent, so that the water resistance of an image that is formed by the dye is greatly increased. Furthermore, the light resistance of the image is also highly increased because the dye trapped between the layers is shielded from direct exposure to external light.

The ink may comprise an acid dye or a direct dye, and the fixing solution may comprise hydrotalcite. According to such a modification, the acid dye or the direct dye is quickly transferred between layers of the hydrotalcite, and an exchange between dye anions and intercalation negative ions, i.e., an intercalation, takes place.

In the use of the recording apparatus, a desired character or image may be printed with the ink and then with the fixing solution, rather than being printed with the fixing solution and then with the ink as described above.

In the use of the recording apparatus, furthermore, the rate at which the fixing solution L and the ink dry may be increased, if necessary, by the heater 11. The rate at which the fixing solution L and the ink dry may be increased by heating the recording medium 2 either in advance of printing or subsequent to printing.

Figure 6:
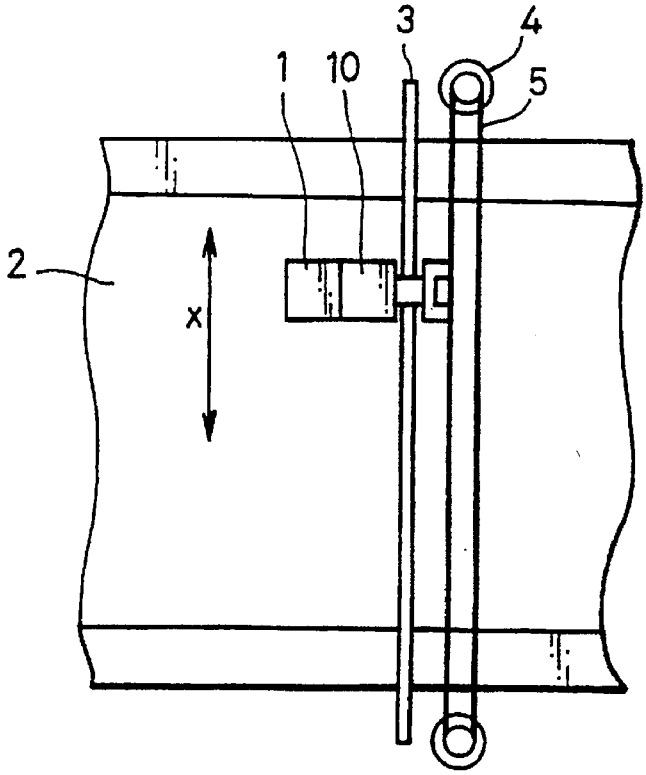
FIG. 6 is a view showing in its entirety an ink jet recording apparatus according to another embodiment of the present invention.

FIG. 6 is a view showing in its entirety an ink jet recording apparatus in its entirety according to another embodiment of the present invention, the ink jet recording apparatus comprising a dye acceptor layer forming means according to the present invention. The recording apparatus according to this embodiment includes a print head 1 having ink nozzles 6 and a fixing solution head 10 having fixing solution nozzles 9, the print head 1 and the fixing solution head 10 being staggered in an auxiliary scanning direction. The other details of the recording apparatus according to this embodiment are identical to those of the recording apparatus according to the embodiment shown in FIG. 1.

In the recording apparatus according to the present invention, the print head 1 and the fixing solution head 10 may thus be switched around in position, and are not limited to any particular positions. Therefore, the print head 1 and the fixing solution head 10 in the recording apparatus according to the embodiments shown in FIGS. 1 and 6 may be switched around in position.

Figure 7:
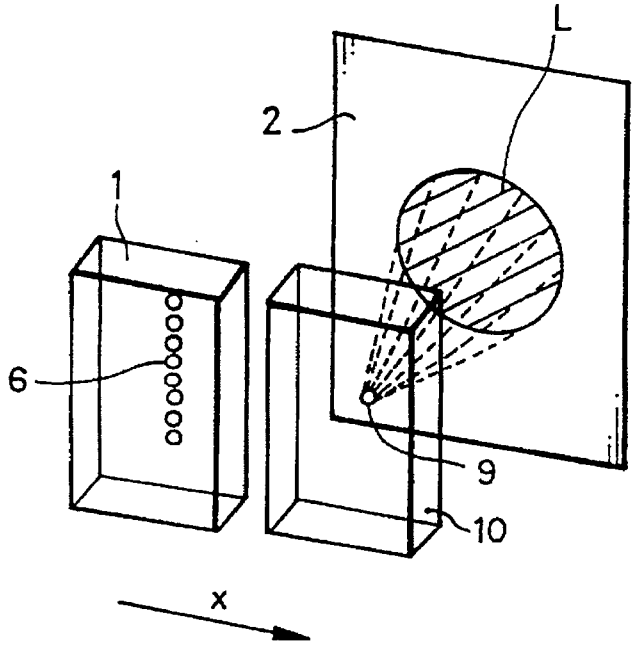
FIG. 7 is a perspective view showing another arrangement of a fixing solution head 10.

The fixing solution head 10 may be arranged as shown in the perspective view of FIG. 7. In this arrangement, the fixing solution head 10 has a single fixing solution nozzle 9, and a spray of fixing solution L (composed of droplets having a diameter of several μm or less, for example) is ejected (sprayed) from the fixing solution nozzle 9 by a solution spray device (not shown) that is actuated by a drive source which employs an electric field, heat, pressure, or the like.

Figure 8:
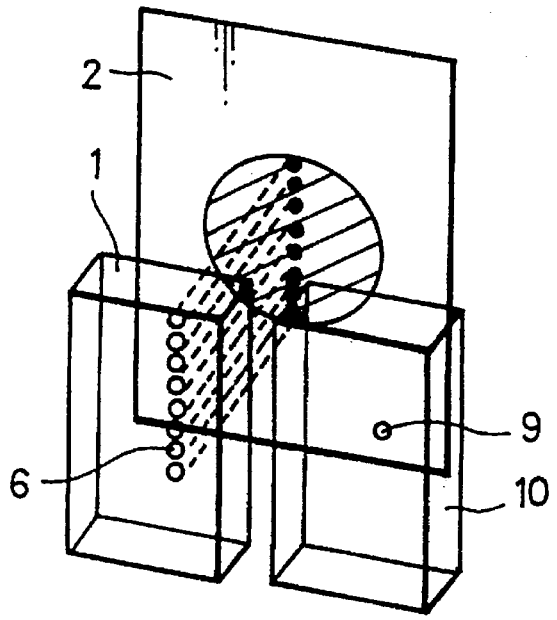
FIG. 8 is a view illustrative of a range of a fixing solution sprayed from the fixing solution head 10 shown in FIG. 7.

The fixing solution L is sprayed in a conical shape from the fixing solution nozzle 9, and a circular pattern (shown hatched in FIG. 7) of the fixing solution D which is formed on the recording medium 2 by being thus sprayed covers a range in which the ink expelled from the array of ink nozzles 6 is attached to the recording medium 2 as shown in FIG. 8.

Figure 9:
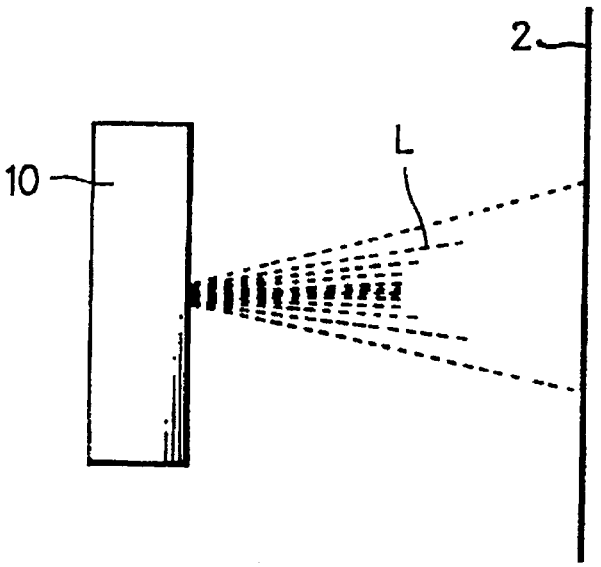
FIG. 9 is a side elevational view of the fixing solution head 10 shown in FIG. 7.

The recording apparatus according to the embodiment shown in FIG. 7 is shown in side elevation in FIG. 9 as viewed from the fixing solution head 10.

Each time the print head 1 and the fixing solution head 10 are scanned, the fixing solution L is sprayed from the fixing solution nozzle 9 and attached to the recording medium 2 along each line thereon.

Since the fixing solution L is applied in a thin layer uniformly without irregularities to the recording medium 2, variations (irregularities) of the thickness of the recording medium 2 which are produced by the attached fixing solution are reduced. Furthermore, the amount of the fixing solution L which is used is also reduced.

If the print head 1 does not print one line in one cycle, but prints one line in a plurality of cycles, i.e., if a line feed interval or pitch corresponds to one of the eight ink nozzles 6 shown in FIG. 7 and hence one dot is printed in eight superposed cycles, then the fixing solution nozzle 9 of the fixing solution head 10 sprays the fixing solution L only in the first scanning stroke, for example, of eight scanning strokes of the print head 1 which are carried out per line.

If the fixing solution L is sprayed in a circular pattern in each scanning stroke of the print head 1 and the fixing solution head 10 in order to cover the range in which the ink is expelled from the ink nozzles 6, as shown in FIG. 8, then the fixing solution L is coated in many superposed layers on the recording medium 2 in the scanning direction of the print head 1 and the fixing solution head 10.

Moreover, in starting and ending zones of the scanning strokes of the print head 1 and the fixing solution head 10 for one line, the fixing solution is sprayed onto the recording medium 2 at areas where no printing is effected. Specifically, zones where one line starts and ends contain areas where no printing is effected with the fixing solution L being left applied in semicircular patterns.

Figure 10:
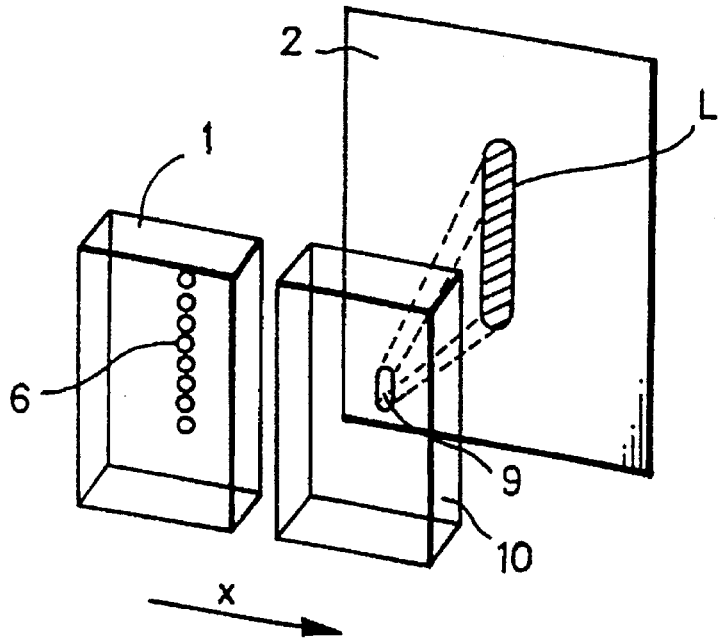
FIG. 10 is a perspective view showing still another arrangement of the fixing solution head 10.
Figure 11:
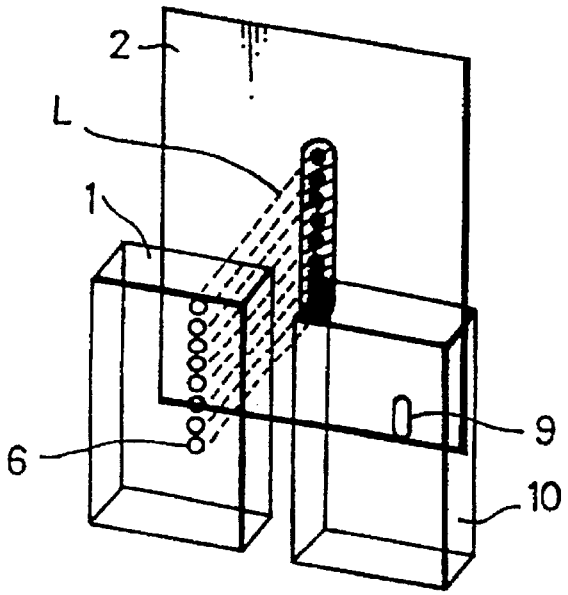
FIG. 11 is a view illustrative of a range of a fixing solution sprayed from the fixing solution head 10 shown in FIG. 10.

To avoid such a problem, the fixing solution head 10 may be arranged as shown in FIG. 10. In FIG. 10, the fixing solution head 10 has a fixing solution nozzle 9 defined in the form of an oblong hole. As shown in FIG. 11, the fixing solution nozzle 9 sprays a fixing solution L in a substantially minimum pattern surrounding the range in which the ink expelled from all the ink nozzles 6 is attached to the recording medium 2.

Since no fixing solution L is applied in superposed layers or no fixing solution L is attached to areas in which no printing is effected by the print head 1, the amount of the fixing solution L used is also reduced. Furthermore, inasmuch as the fixing solution L is uniformly applied to the recording medium 2, the finished appearance of the recording medium is improved.

The fixing solution nozzle 9 may be of a vertically elongate shape such as a rectangular shape or a linear shape, rather than the shape of an oblong hole.

Figure 12:
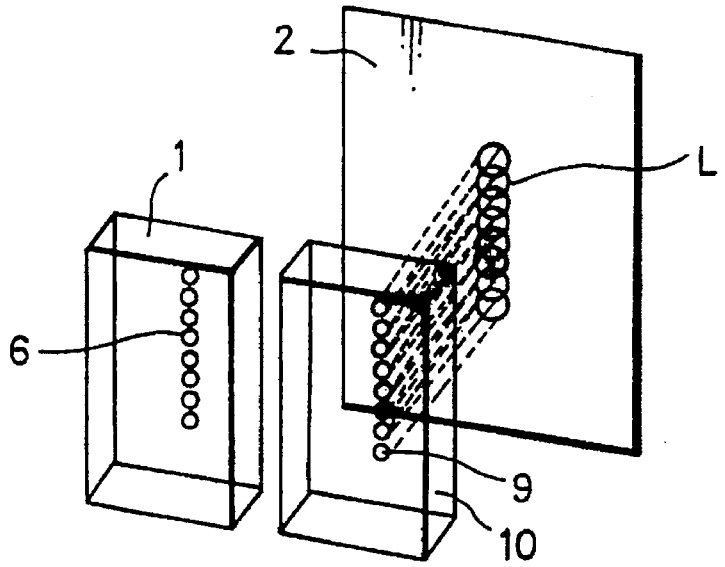
FIG. 12 is a perspective view showing yet still another arrangement of the fixing solution head 10.
Figure 13:
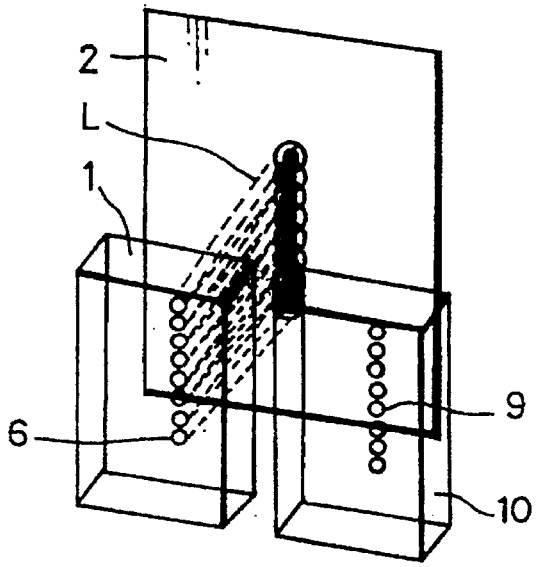
FIG. 13 is a view illustrative of a range of a fixing solution sprayed from the fixing solution head 10 shown in FIG. 12.

FIG. 12 shows yet still another arrangement of the fixing solution head 10. The fixing solution head 10 has fixing solution nozzles 9 defined therein at positions that are held in positional one-to-one corresponding to the ink nozzles of the print head 1. As shown in FIG. 13, the fixing solution nozzles 9 spray a fixing solution L in substantially minimum ranges that surround areas in which the ink expelled from the respective ink nozzles 6 is attached to the recording medium 2, i.e., respective dots.

At this time, the fixing solution L may be sprayed from all the fixing solution nozzles 9 at all times. However, the fixing solution L may be sprayed selectively from only those of the fixing solution nozzles 9 which correspond to those ink nozzles 6 that expel the ink.

Figure 14:
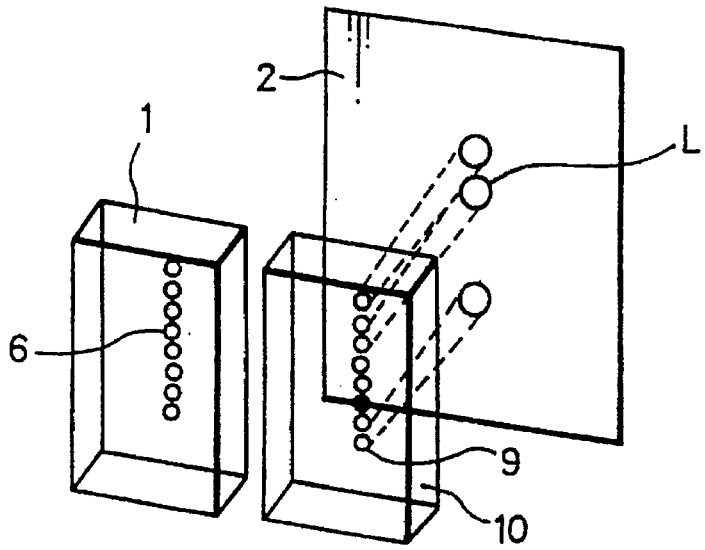
FIG. 14 is a view illustrative of the manner in which the fixing solution head 10 shown in FIG. 12 operates.
Figure 15:
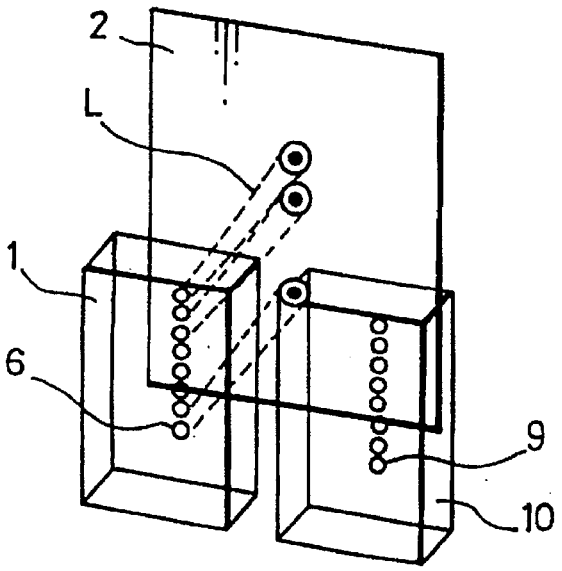
FIG. 15 is a view illustrative of the manner in which the fixing solution head 10 shown in FIG. 12 operates.

Specifically, as shown in FIG. 14, if the ink is expelled from first, third, and eighth ink nozzles 6, as counted from above, of all the ink nozzles 6, then the fixing solution L is also sprayed from first, third, and eighth fixing solution nozzles 9 as counted from above. In this arrangement, the fixing solution L is applied to only those areas where printing is effected by the print head 1, as shown in FIG. 15, so that the amount of the fixing solution L used is greatly reduced.

The ranges where the sprayed fixing solution L is attached to the recording medium 2 may be adjusted by varying the shape and size of the spray ports of the fixing solution nozzles 9 or the pressure under which the fixing solution L is sprayed. The ranges may also be adjusted by varying the distance between the fixing solution head 10 and the recording medium 2 or tapering inner side surfaces of the fixing solution nozzles 9.

In spraying the fixing solution L in the manner described above, the sequence in which the ink and the fixing solution L are applied and the positions of the print head 1 and the fixing solution head 10 are not limited to any particular configuration, as is the case with the embodiments shown in FIGS. 1 through 3 and 6.

To use the recording apparatus for spraying the fixing solution L as described above, the fixing solution L was produced as follows: 75 g of synthetic smectite (tradename "SWN" manufactured by Coop Chemical Co. Ltd.) was charged into 400 g of an ethanol solution containing 25 g of polyvinyl butyral (tradename "BL-1" manufactured by Sekisui Chemical Co., Ltd.), and dispersed therein by a roll mill for two days. Then, 150 g of an ethanol solution containing 30 g of diethylene glycol was added to the dispersion, and dispersed therein for one day, thereby producing a fixing solution L.

The ink to be used in the recording apparatus was prepared according to a composition as follows:

| (Ink composition) | |
|---|---|
| Basic dye | 2 parts by weight |
| Glycerin | 2 parts by weight |
| Diethylene glycol | 6 parts by weight |
| Water | 30 parts by weight. |

Basic dyes for respective colors Y, M, C, B were as follows: (Dyes)

Y: C. I. basic yellow 51

M: C. I. basic red 46

C: C. I. basic blue 75

B: C. I. basic black 2.

Figure 16:
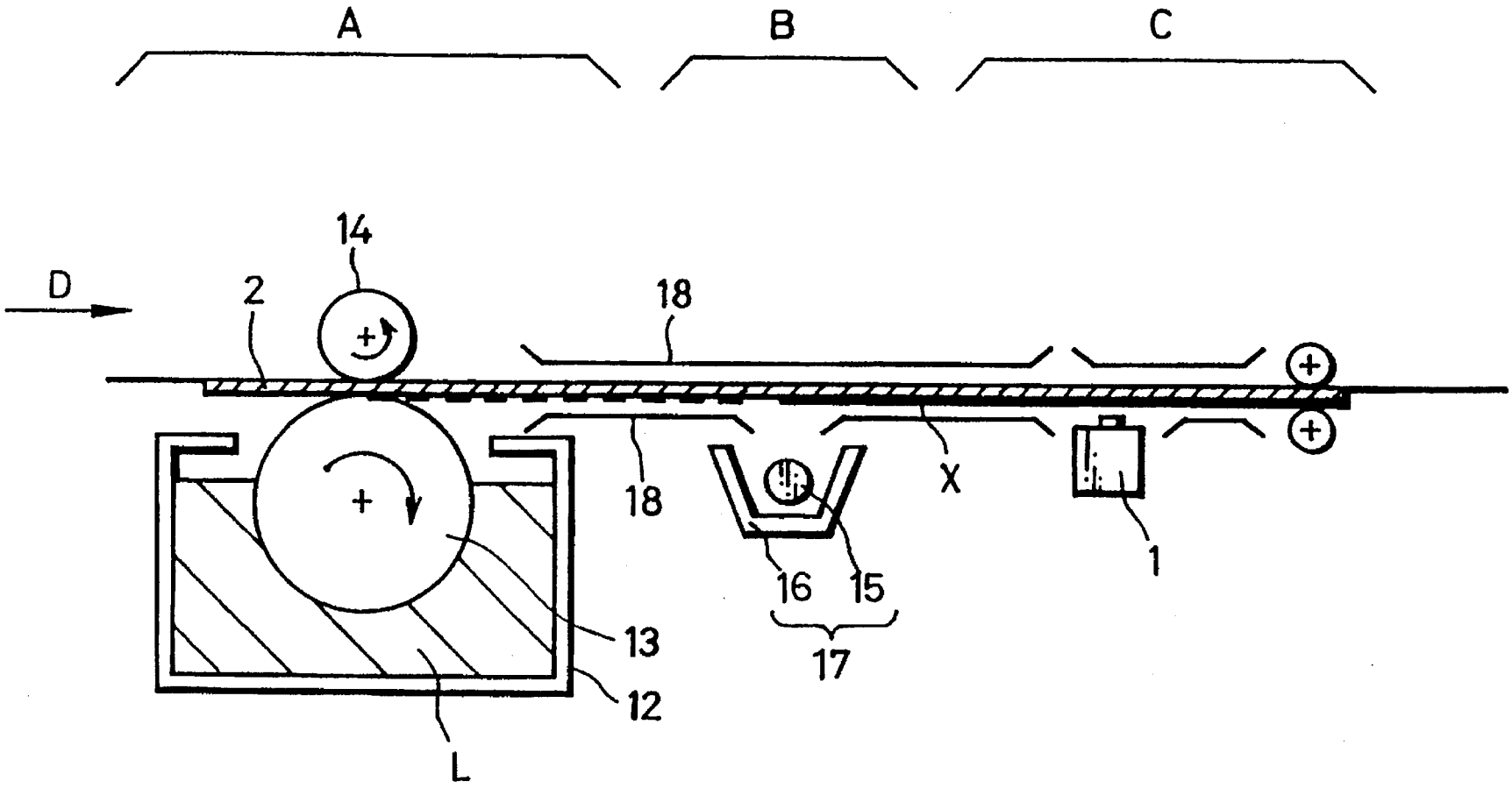
FIG. 16 is a view showing in its entirety an ink jet recording apparatus according to still another embodiment of the present invention.

FIG. 16 is a view showing in its entirety an ink jet recording apparatus according to still another embodiment of the present invention. The ink jet recording apparatus according to this embodiment comprises a serial ink jet printer having a dye acceptor layer forming means according the present invention. However, rather than expelling (the term has a wide sense including spraying) a fixing solution L from nozzles onto a recording medium 2 to form a dye acceptor layer, the fixing solution L is coated on the recording medium 2 by a coating roller 13 to form a dye acceptor layer on the recording medium 2.

Specifically, the recording apparatus shown in FIG. 16 comprises a fixing solution coating section A, a drying section B, and a printing section C. The fixing solution coating section A has a solution reservoir 12 for holding a fixing solution L therein, a coating roller 13 for coating the fixing solution L on a recording medium 2, and a counterroller 14 disposed opposite to the coating roller 13. The drying section B has an oven 17 comprising a heater 15 and a reflecting plate 16. The printing section C has a print head 1 for expelling an ink.

To use the recording apparatus shown in FIG. 16, a fixing solution L is placed in the solution reservoir 12 in advance. The coating roller 13 is uniformly wetted with the fixing solution L. When the recording medium 2 is fed in the direction indicated by the arrow D and gripped between the coating roller 13 and the counterroller 14, the fixing solution L on the coating roller 13 is transferred onto the recording medium 2 which is now uniformly wetted with the fixing solution L. The recording medium 2 that is coated with the fixing solution L is fed through guides 18 into the drying section B in which the recording medium 2 is dried by the oven 17, thus forming a dye acceptor layer X on the recording medium 2. Thereafter, an ink is ejected from the print head 1 to form an image on the recording medium 2 in the same manner as described above with respect to the recording medium according to the embodiment shown in FIGS. 1 through 3.

In this embodiment in which the fixing solution L is coated on the recording medium 2 by the coating roller 13, the fixing solution L may be coated on the recording medium 2 after it is printed by the ink, rather than printing the recording medium 2 after it is coated with the fixing solution L. In the recording apparatus shown in FIG. 16, the oven 17 is positioned on the same side of the recording medium 2 as the print head 1, the oven 17 may be positioned on the opposite side of the recording medium 2. The oven 17 may be replaced with a heat roller or the like. The drying section B may be dispensed with depending on the rate at which the fixing solution L dries.

Figure 17:
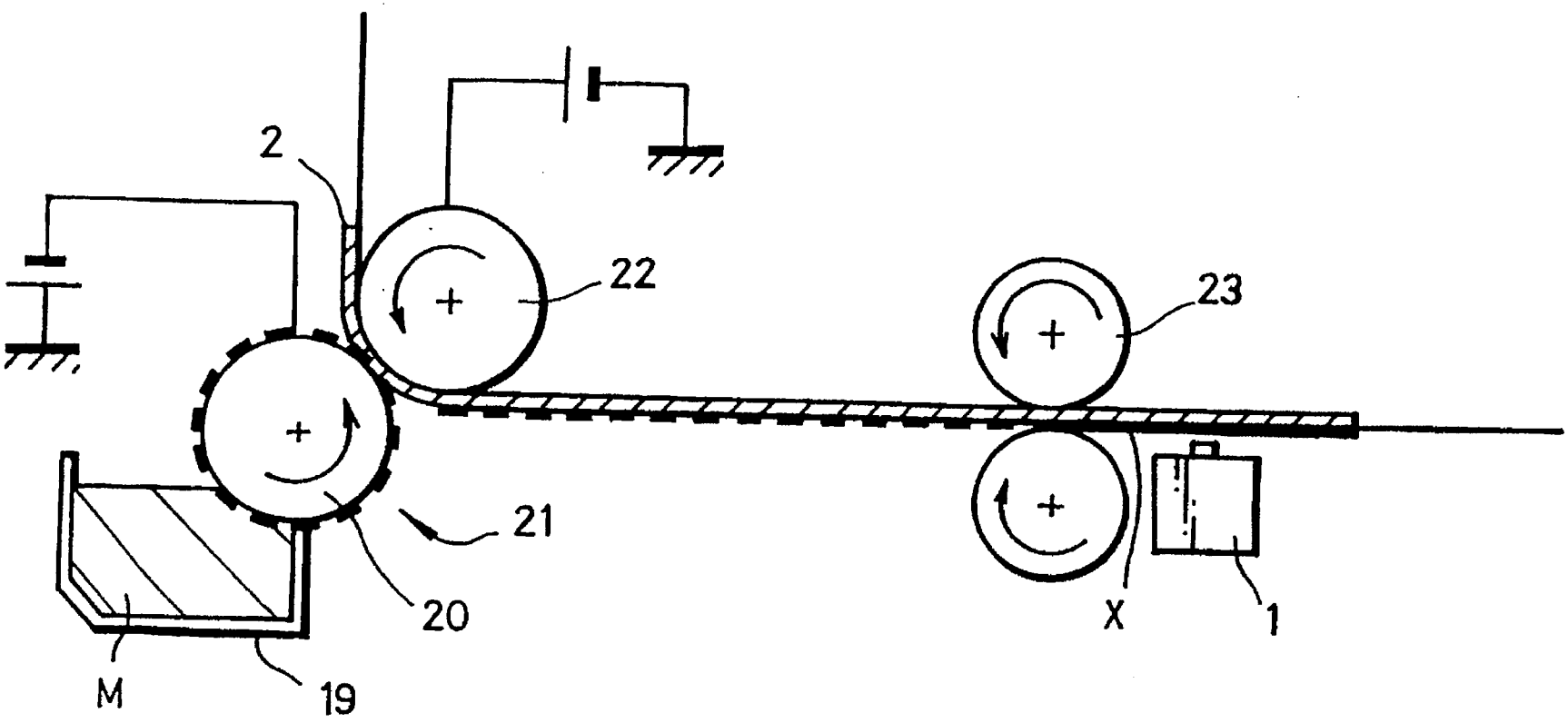
FIG. 17 is a view showing in its entirety an ink jet recording apparatus according to yet still another embodiment of the present invention.

FIG. 17 is a view showing an ink jet recording apparatus according to yet still another embodiment of the present invention, the ink jet recording apparatus having a dye acceptor layer forming means for forming a dye acceptor layer using a clay powder M.

The ink jet recording apparatus according to the embodiment shown in FIG. 17 comprises, as the dye acceptor layer forming means, a clay powder reservoir 19 for holding a clay powder M, a clay drum 20 for attaching the clay powder electrostatically to a recording medium 2, a powder cutting blade 21 for keeping constant the height of the clay powder M attached to the clay drum 20, a clay attaching roller 22 for charging the recording medium 2 to a potential opposite to that of the clay powder M to attach the clay powder M to the recording medium 2, and fixing rollers 23 for heating the clay powder M attached to the recording medium 2 to fix the clay powder M to the recording medium 2. The fixing rollers 23 may have halogen lamps or the like disposed therein for heating the clay powder M to a temperature ranging from about 150° to 200° C.

A print head 1 having ink jet nozzles is disposed subsequently to the dye acceptor layer forming means.

To use the ink jet recording apparatus shown in FIG. 17, a clay powder M and a carrier (iron powder) are placed in the clay powder reservoir 19. Then, while a bias potential (e.g., −3—4 kV) is being applied to the clay drum 20 and a bias potential (e.g., +3~+4 kV) is being applied to the clay attaching roller 22, the clay drum 20 is rotated to triboelectrically charge the clay powder M and the carrier to respective opposite polarities. When the recording medium 2 is fed between the clay drum 20 and the clay attaching roller 22, the clay powder M on the clay drum 20 is attached under electrostatic forces to the recording medium 2 that has been charged to the polarity opposite to the clay powder M by the clay attaching roller 22. Then, the clay powder M attached to the recording medium 2 is heated by the fixing rollers 23 and hence fixed to the recording medium 2. In this manner, a dye acceptor layer X composed of an intercalation compound is formed on the recording medium 2. Thereafter, an ink is expelled from the print head 1 to form an image on the recording medium 2 with the dye acceptor layer X formed thereon.

Figure 18:
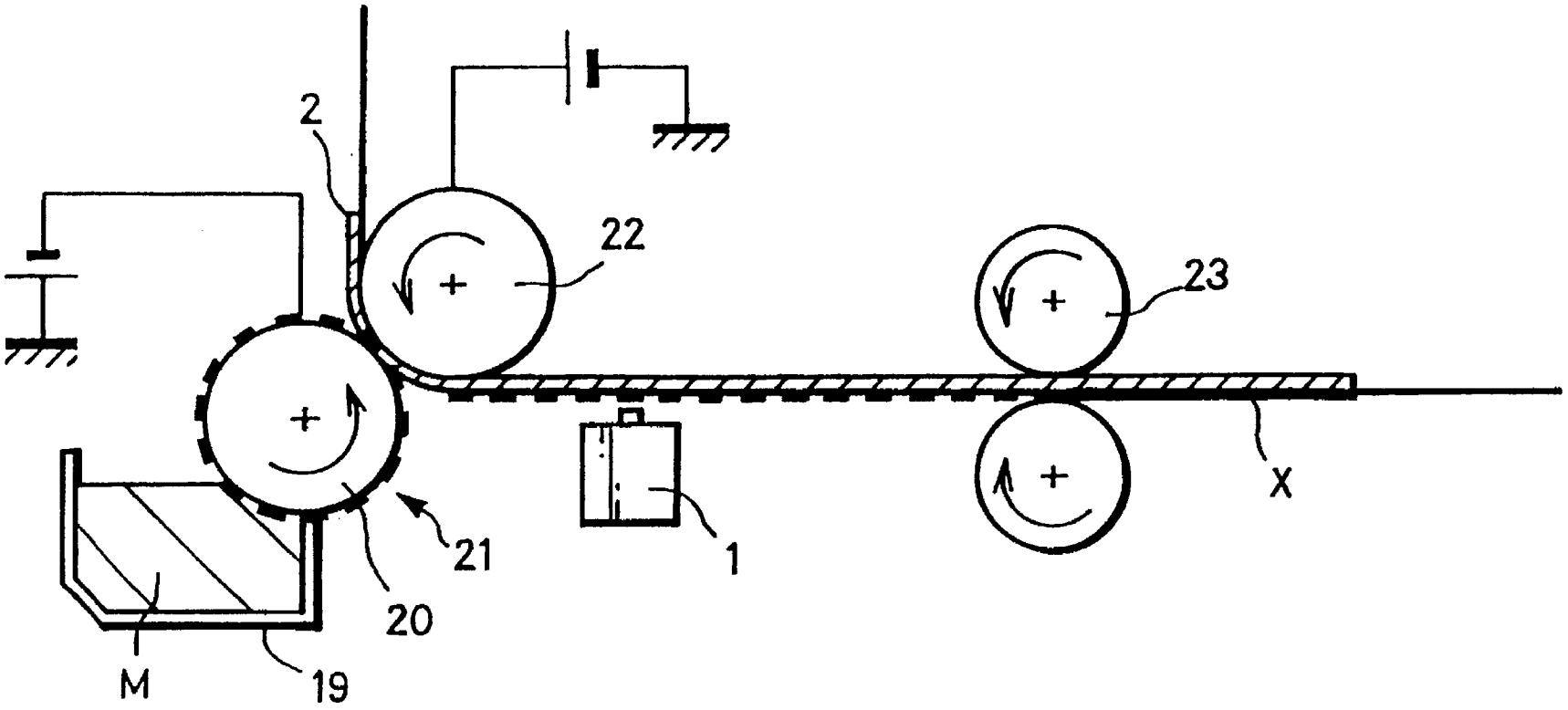
FIG. 18 is a view showing in its entirety an ink jet recording apparatus according to a further embodiment of the present invention.

FIG. 18 shows a modification of the ink jet recording apparatus shown in FIG. 17. In the ink jet recording apparatus shown in FIG. 18, after the clay powder M is attached to the recording medium 2 and before it is fixed by the fixing rollers 23, an image is formed on the recording medium 2 with an ink by the print head 1. Thereafter, the clay powder M is fixed by the fixing rollers 23, forming a dye acceptor layer X. The other details of the ink jet recording apparatus shown in FIG. 18 except that the fixation of the clay powder M and the formation of the ink image are switched around but are identical to those of the ink jet recording apparatus shown in FIG. 17.

Figure 19:
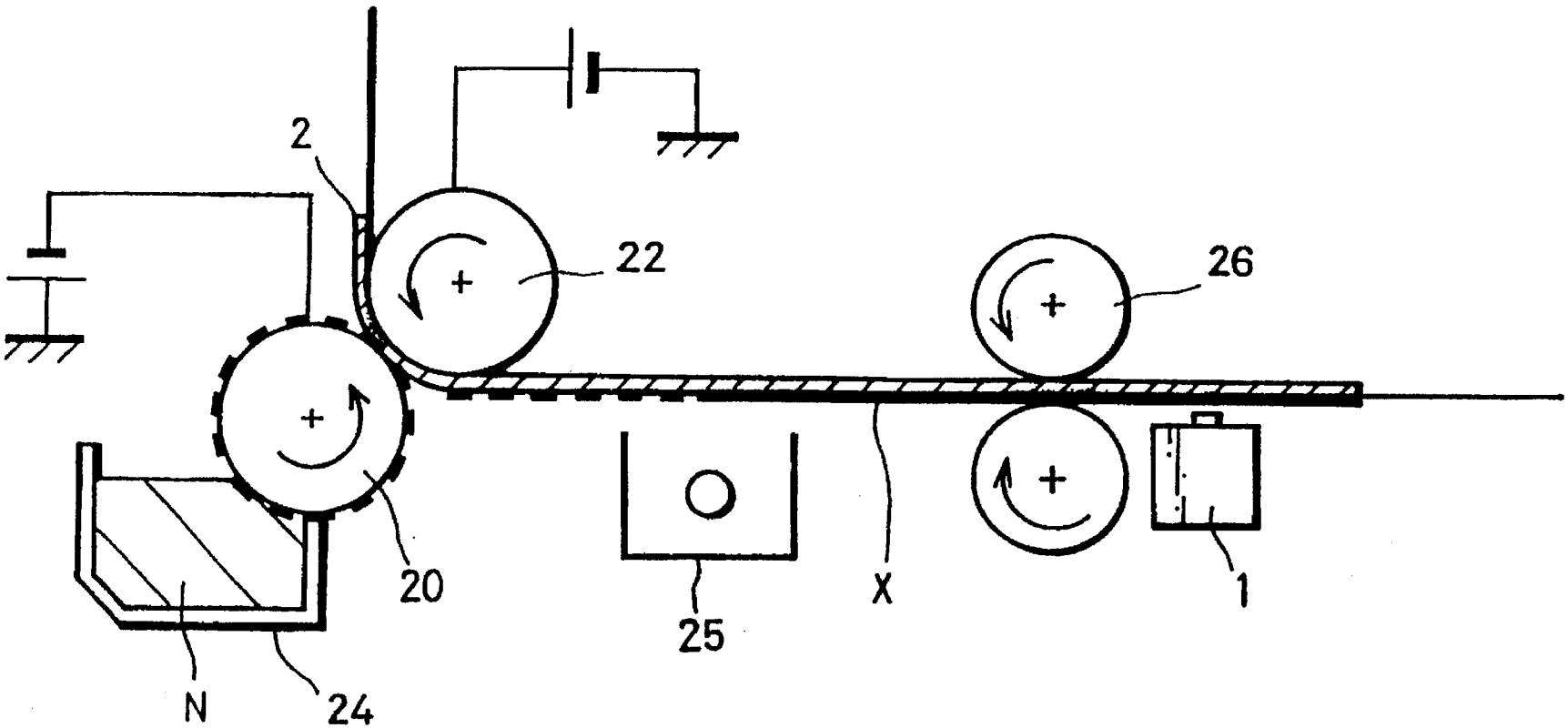
FIG. 19 is a view showing in its entirety an ink jet recording apparatus according to a still further embodiment of the present invention.

FIG. 19 shows another modification of the ink jet recording apparatus shown in FIG. 17. The ink jet recording apparatus shown in FIG. 19 employs a clay liquid N instead of the clay powder M employed in the ink jet recording apparatus shown in FIG. 17. The ink jet recording apparatus shown in FIG. 19 has a clay liquid reservoir 24 which holds a clay liquid N that is prepared by dispersing a clay powder composed of an epoxy resin binder and an intercalation compound into an insulating solvent such as of dibutyl phthalate or the like. The clay liquid N is triboelectrically charged to a potential ranging from −3~−4 kV, for example, while a bias potential (e.g., +300~+400 V) that is of an opposite polarity to the clay liquid N is being applied to the clay drum 20 and a bias potential ranging from +3~+4 kV, for example, is being applied to the clay attaching roller 22. When the recording medium 2 is fed between the clay drum 20 and the clay attaching roller 22, the recording medium 2 is charged to an opposite polarity to the clay liquid N by the clay attaching roller 22, and the clay liquid N is attached to the recording medium 2 under electrostatic forces acting between the recording medium 2 and the clay liquid N. Then, the recording medium 2 to which the clay liquid N is attached is heated to a temperature ranging from 50° to 200° C. by a heater 25, whereupon the clay liquid N is dried and fixed to the recording medium 2, thus forming a dye acceptor layer X on the recording medium 2. The recording medium 2 with the dye acceptor layer X thus formed thereon is fed by sheet feed rollers 26 to a subsequent printing section where an image is formed on the recording medium 2 with an ink by the print head 1.

Figure 20:
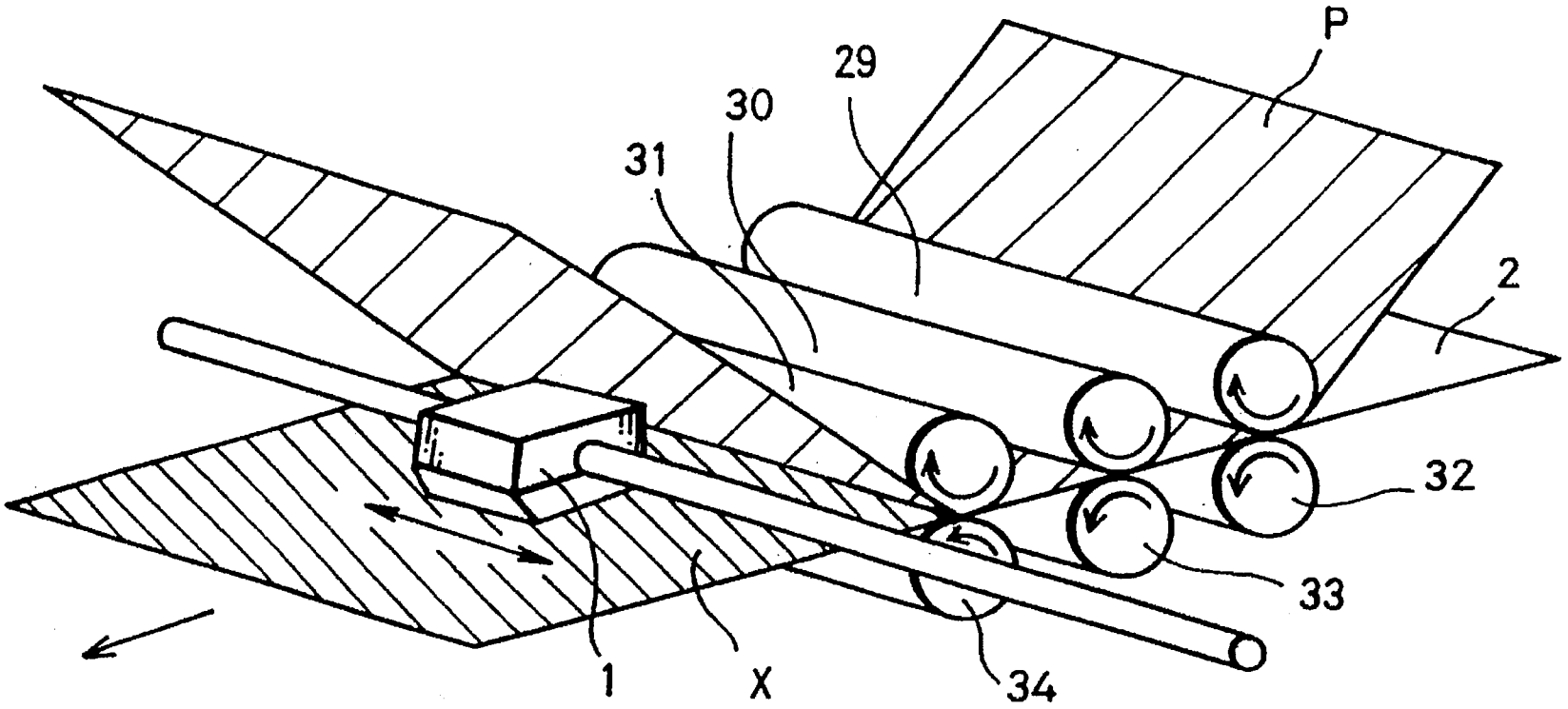
FIG. 20 a view showing in its entirety an ink jet recording apparatus according to a yet still further embodiment of the present invention.
Figure 21A:
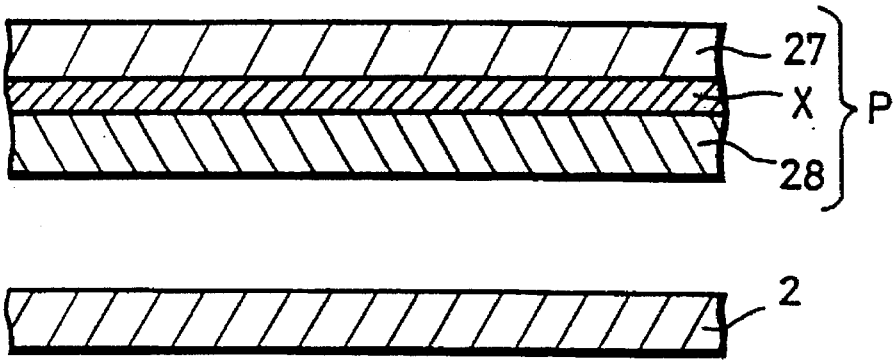
FIG. 21A and 21B are views illustrative of the manner in which a dye acceptor layer X formed in a ribbon P is thermally transferred onto a recording medium 2.
Figure 21B:
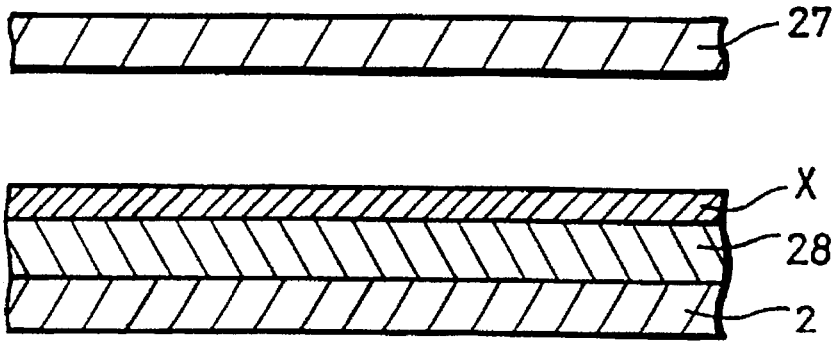

FIG. 20 is a view showing in its entirety an ink jet recording apparatus according to a yet still further embodiment of the present invention. In the ink jet recording apparatus shown in FIG. 20, a dye acceptor layer X formed in a ribbon P is thermally transferred onto a recording medium 2 to form the dye acceptor layer X on the recording medium 2. FIG. 21A and 21B are views illustrative of the manner in which the dye acceptor layer X formed in the ribbon P is thermally transferred onto the recording medium 2.

As shown in FIG. 21A, the ribbon P for use in the ink jet recording apparatus comprises a successively laminated structure composed of a base film 27, a dye acceptor layer X, and an adhesive layer 28. It was possible to produce the ribbon P as follows:

20 g of synthetic smectite (tradename "SWN" manufactured by Coop Chemical Co. Ltd.) was dispersed and swollen in one liter of water. To the dispersion, there was added the same amount of ethanol as the dispersion. While stirring the mixture, 0.65 g (1 mg equivalent) of tetra-n-decylammonium bromide dissolved in 200 ml of ethanol was dropped into the mixture. After being left for one day, the aggregated precipitate was filtered out and cleaned with ethanol, removing quaternary ammonium salt. The cleaned precipitate was dried at 70° C. into a purely white powder. 20 g of the produced powder was charged into 120 g of an ethanol solution containing 10 weight % of hydroxypropyl cellulose, and dispersed by a roll mill for two days, thus producing a suspension. To the suspension were added 2 g of trifunctional isocyanate (Colonate HL manufactured by Nippon Polyurethane Co., Ltd.) and 1 g of an ultraviolet light absorber (Seesolob 101S manufactured by Cipro Chemical Co., Ltd.), thereby producing a composition for forming a dye acceptor layer.

A PET film having a thickness of 6 μm and including a surface processed for releasability was prepared as a base film. The processed surface of the PET film was coated with a composition for forming a dye acceptor layer by a wire bar, and dried with hot air at 120° C. for five minutes, thereby forming a dye acceptor layer in the form of a solid film having a thickness of 5 μm.

Then, an adhesive composed of 2 parts by weight of vinylidene chloride - acrylonitrile copolymer (manufactured by Aldrich Corp.) and 20 parts by weight of methyl ethyl ketone was prepared, and coated on the dye acceptor layer using a bar coater, to a wet thickness of 50 μm. The coated adhesive was then dried into an adhesive layer.

In this manner, the ribbon P as shown in FIG. 21A was produced.

The ink jet recording apparatus shown in FIG. 20 comprises, as a dye acceptor layer forming means, a ribbon holding means (not shown) for holding a ribbon P in the recording apparatus, a heat roller 29 for heating the ribbon P which is drawn from the ribbon holding means, a cooling roller 30 for cooling the ribbon P after a dye acceptor layer X is thermally transferred, a peeling roller 31 for peeling a base film 27 of the ribbon P from the dye acceptor layer X, and platen rollers 32 through 34 for pressing a recording medium 2 against the ribbon P. The ink jet recording apparatus also has a serial print head 1 disposed subsequently to the dye acceptor layer forming means.

The ink jet recording apparatus shown in FIG. 20 was operated to form an image on a recording medium 2 of synthetic paper having a thickness of 100 μm as follows: The ribbon P and the recording medium 2 were set in the recording apparatus such that the adhesive layer 28 of the ribbon P confronted the recording medium 2. The ribbon P and the recording medium 2 were fed at a rate of 3 cm/second between the heat roller 29 heated to 120° C. and the platen roller 32, so that the ribbon P and the recording medium 2 were heated and pressed, bonding the dye acceptor layer X of the ribbon P to the recording medium 2 through the adhesive layer 28. At this time, the dye acceptor layer X was bonded to the recording medium 2 over its full width (in a direction perpendicular to the direction of feed of the recording medium 2). Then, the ribbon P and the recording medium 2 were cooled to room temperature by the cooling roller 30, and the base film 27 of the ribbon P was peeled off the dye acceptor layer X bonded to the recording medium 2 by the peeling roller 31. In this manner, the dye acceptor layer X was thermally transferred from the ribbon P to the recording medium 2 as shown in FIG. 21B. On the recording medium 2 with the dye acceptor layer X thermally transferred thereto, there was formed an image with an ink having the following composition by the print head 1:

| (Ink composition) | |
|---|---|
| Basic dye | 2 parts by weight |
| P-toluenesulfonic acid soda | 2 parts by weight |
| Diethylene glycol | 20 parts by weight |
| Polyethylene glycol | 20 parts by weight |
| Water | 50 parts by weight. |

Basic dyes for respective colors Y, M, C, B were as follows:

(Dyes)

Y: C. I. basic yellow 51

M: C. I. basic red 23

C: C. I. basic blue 75

B: C. I. basic black 2.

A high-quality image having a circular dot shape was thus formed.

The produced image was immersed in water for one day and night, and thereafter the surface of the image was pressed strongly and rubbed by a finger. However, no dye was eluted, and no dye acceptor layer was separated from the dye acceptor layer, indicating that the image had good fixability. Furthermore, the image was exposed to Xe light (90000 kJ/$m^2$) at 30° C. and 65% RH. The remaining dye of each of the colors was 80% or greater, indicating that the image exhibited a high level of light resistance comparable with silver-salt photographs.

Figure 22:
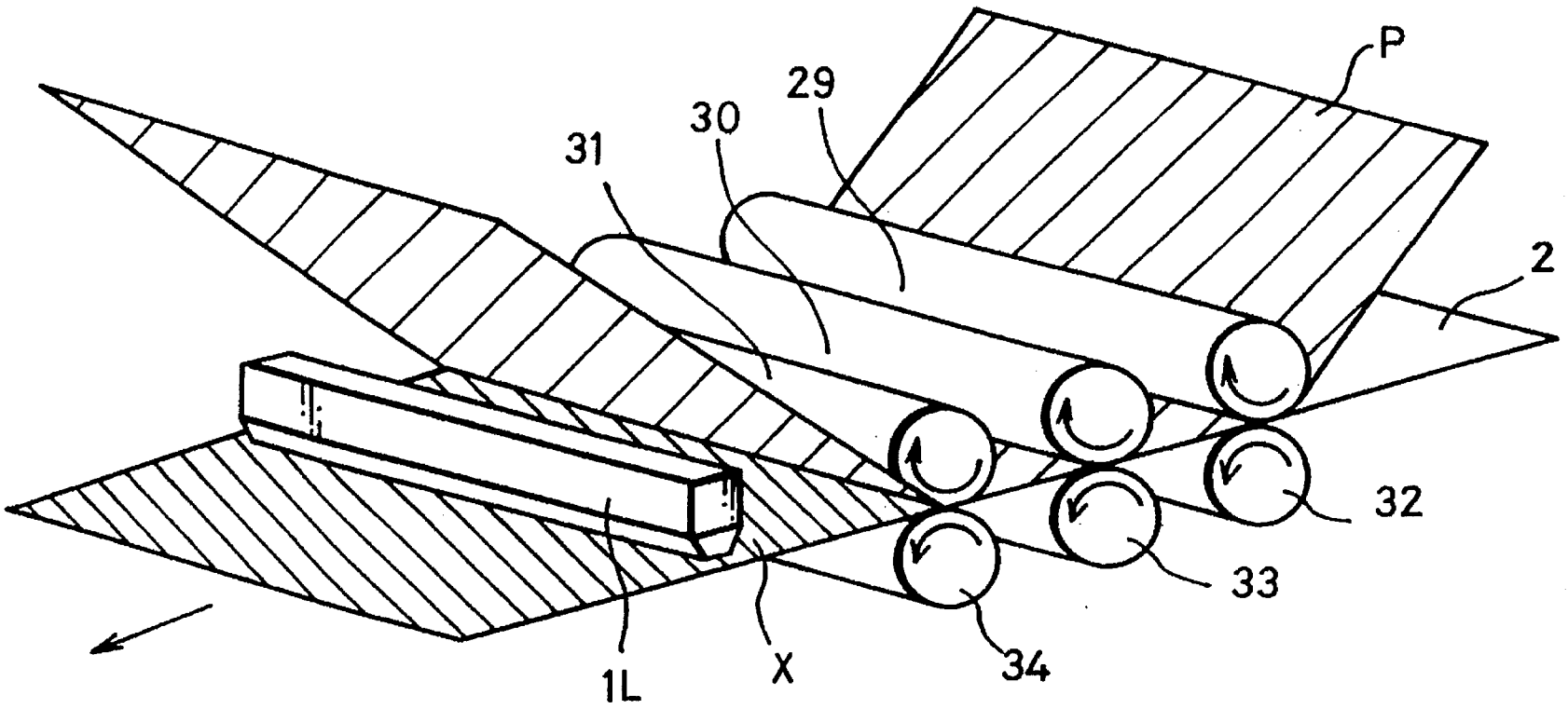
FIG. 22 a perspective view showing in its entirety an ink jet recording apparatus according to another embodiment of the present invention.

FIG. 22 shows a modification of the ink jet recording apparatus shown in FIG. 20. In the ink jet recording apparatus shown in FIG. 22, after a dye acceptor layer X has been formed on a recording medium 2 by thermal transfer, an image is formed on the recording medium 2 by a line print head 1L. The other details of the ink jet recording apparatus shown in FIG. 22 are identical to those of the ink jet recording apparatus shown in FIG. 20. Since the ink jet recording apparatus shown in FIG. 20 allows the dye acceptor layer X to be easily formed on the recording medium over its full width, it also may have a line print head 1L as is the case with the ink jet recording apparatus shown in FIG. 22.

Figure 23:
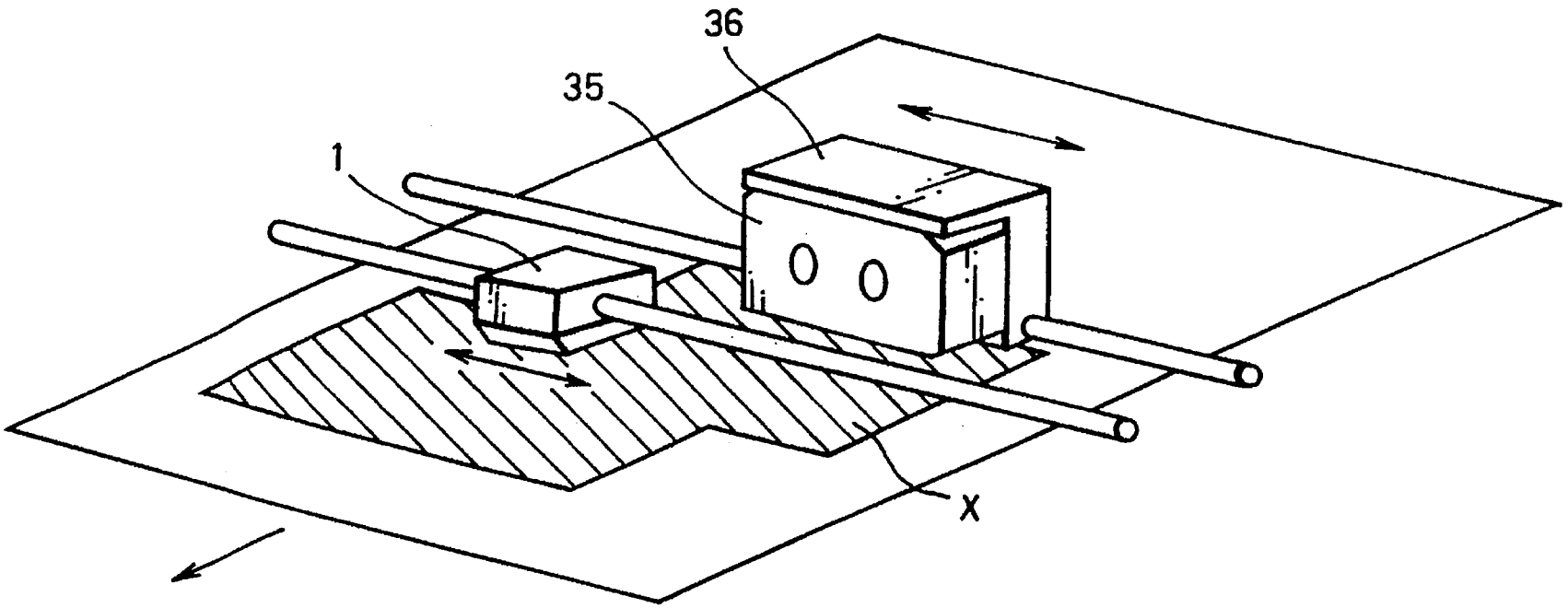
FIG. 23 is a perspective view showing in its entirety an ink jet recording apparatus according to still another embodiment of the present invention.

FIG. 23 shows an ink jet recording apparatus in which a dye acceptor layer X is formed on a recording medium 2 using a ribbon P as with the ink jet recording apparatus shown in FIG. 20. In the ink jet recording apparatus shown in FIG. 23, the ribbon P is wound in a ribbon cassette 35 which is mounted on a cassette holder 36 that has a heater (not shown), and the dye acceptor layer X of the ribbon P drawn from the ribbon cassette 35 can be thermally transferred to the recording medium 2 by the heater of the cassette holder 36. The ink jet recording apparatus shown in FIG. 23, therefore, makes it possible to form a dye acceptor layer only in a certain print region, and hence can be reduced in size.

The cassette holder 36 which holds the ribbon cassette 35 that stores the ribbon P may be integral with a serial print head 1 for achieving a further reduction in the size of the ink jet recording apparatus. In this arrangement in which the ribbon P is stored in the ribbon cassette 35, the print head may comprise a line print head.

Figure 24:
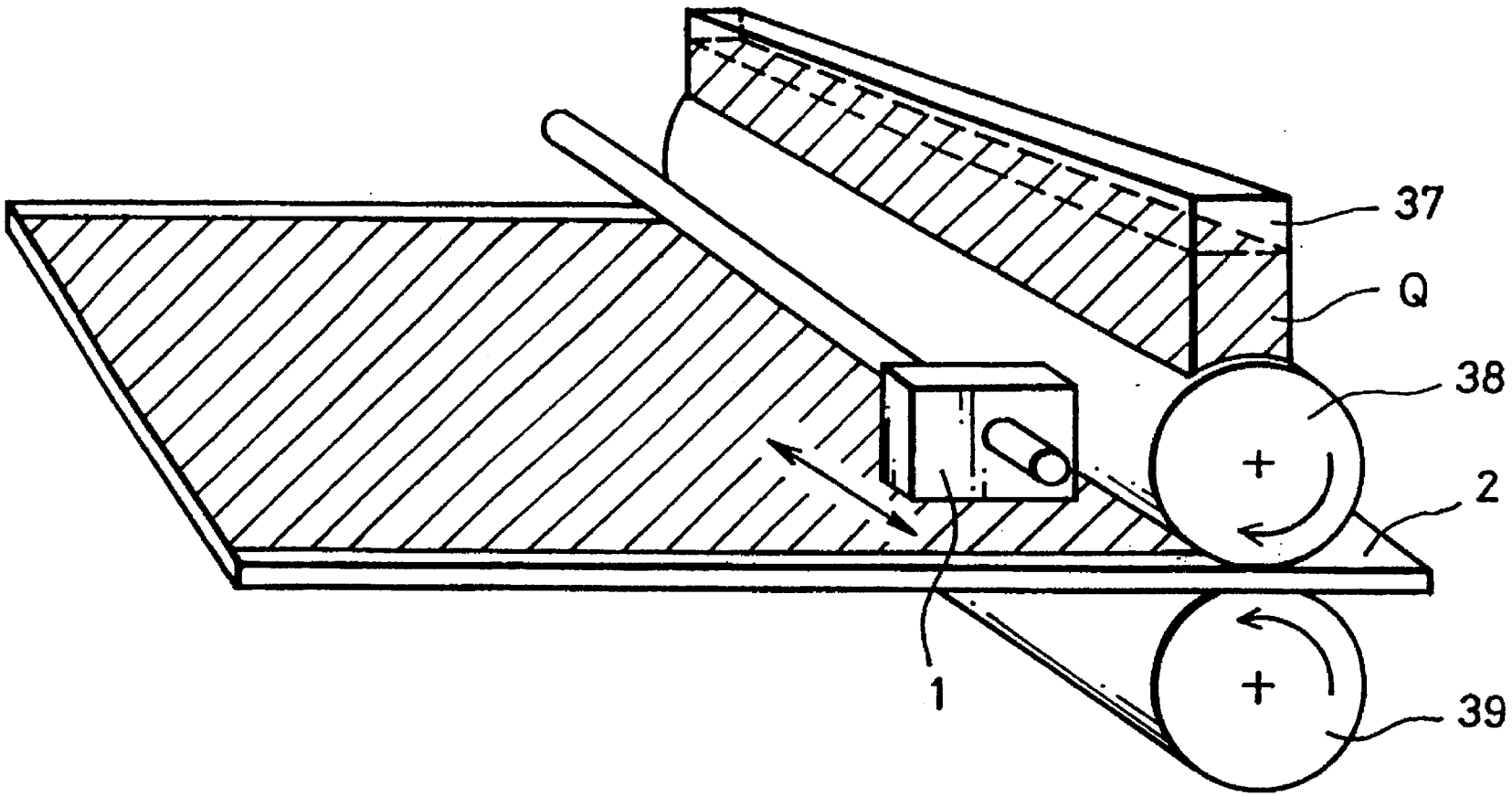
FIG. 24 is a perspective view showing in its entirety an ink jet recording apparatus according to yet still another embodiment of the present invention.
Figure 25:
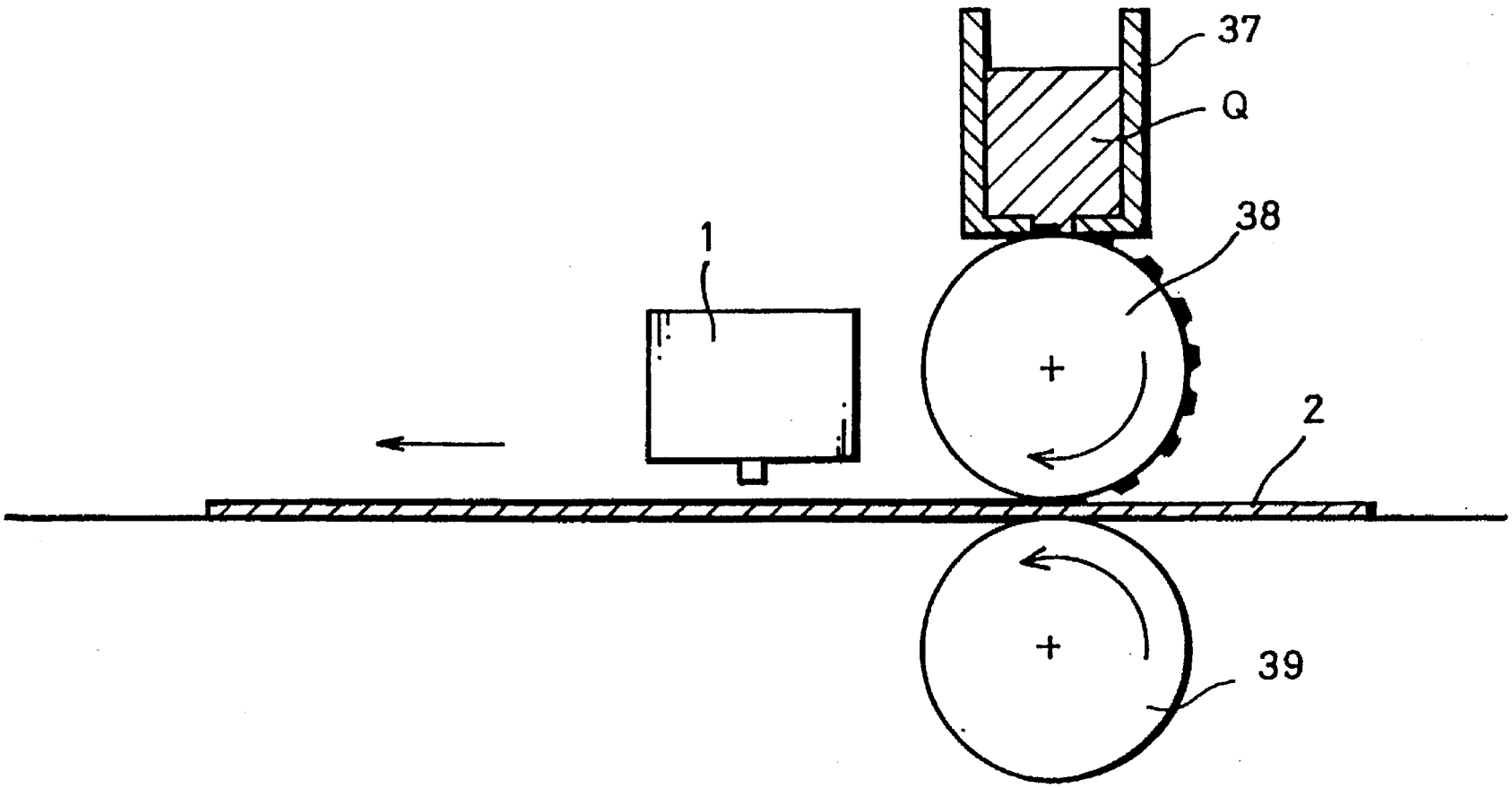
FIG. 25 is a cross-sectional view of the ink jet recording apparatus according to the embodiment shown in FIG. 24.

FIG. 24 shows an ink jet recording apparatus in its entirety in which a fixing agent Q that contains an intercalation compound dispersed in wax and is solid at normal temperature is melted and coated on a recording medium 2 thereby to form a dye acceptor layer on the recording medium 2. FIG. 25 is a cross-sectional view of the ink jet recording apparatus.

The ink jet recording apparatus shown in FIG. 24 comprises, as a dye acceptor layer forming means, a solid fixing agent cassette 37 for holding a solid fixing agent Q such that the solid fixing agent Q is pressed against a heat roller 38, a heat roller 38 for melting the solid fixing agent Q with heat and coating the melted solid fixing agent Q on a recording medium 2 upon rotation in the direction indicated by the arrow, and a pressing roller 39 positioned opposite to the heat roller 38 and rotatable in the direction indicated by the arrow for pressing the recording medium 2. The ink jet recording apparatus shown in FIG. 24 also has a serial print head 1 subsequently to the dye acceptor layer forming means.

Before the ink jet recording apparatus shown in FIG. 24 is used, two solid fixing agents Q-1, Q-2 were produced as follows:

(Solid fixing agent Q-1)

75 g of synthetic smectite (tradename "SW" manufactured by Coop Chemical Co. Ltd.), 22.5 g of carnauba wax (manufactured by Toyo Petrolite Co., Ltd.), and 52.5 g of paraffin wax (tradename "HNP-3" manufactured by Nippon Seiro Co., Ltd.) were kneaded by a roll mill at 120° C. for four hours, and left at normal temperature, thereby producing a solid fixing agent Q-1.

(Solid fixing agent Q-2)

150 g of synthetic smectite (tradename "SW" manufactured by Coop Chemical Co. Ltd.) was charged into 1 kg of an ethanol solution containing 10% by weight of polyvinyl butyral (tradename "BL-1" manufactured by Sekisui Chemical Co., Ltd.), and dispersed therein by a roll mill for two days, thus producing a suspension. Then, the suspension was placed in a drying furnace at 110° C., producing a solid fixing agent Q-2.

The ink to be used in the recording apparatus was prepared according to a composition as follows:

| (Ink composition) | |
|---|---|
| Basic dye | 2 parts by weight |
| Glycerin | 2 parts by weight |
| Diethylene glycol | 6 parts by weight |
| Water | 30 parts by weight. |

Basic dyes for respective colors Y, M, C, B were as follows:

(Dyes)

Y: C. I. basic yellow 2

M: C. I. basic red 46

C: C. I. basic blue 3

B: C. I. basic black 2.

Using the solid fixing agents Q-1, Q2 and the ink thus prepared, an image was formed on a sheet of plain paper by the ink jet recording apparatus shown in FIG. 24. The heat roller 38 was set to a temperature (80°~120° C.) equal to or higher than the melting points of the solid fixing agents, and the linear pressure between the rollers was set to 3 kg/cm. The heat roller 38 and the pressing roller 39 were rotated at a speed of 10 mm/s. As a result, an image was formed well on a dye acceptor layer which was formed using either the solid fixing agent Q-1 or the solid fixing agent Q-2.

Figure 26:
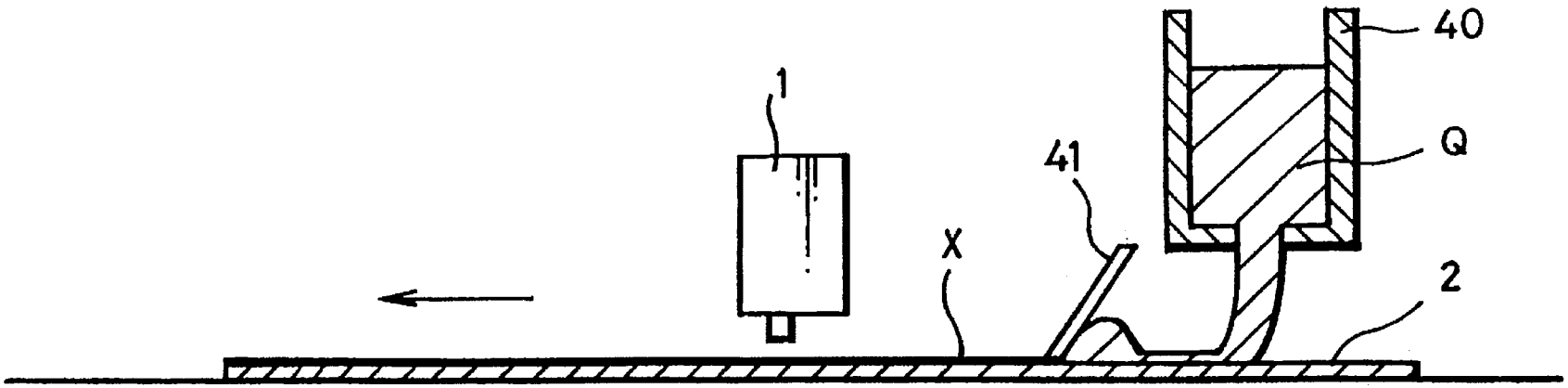
FIG. 26 is a cross-sectional view of an ink jet recording apparatus according to a further embodiment of the present invention.

FIG. 26 is a cross-sectional view of an ink jet recording apparatus according to a further embodiment of the present invention. The ink jet recording apparatus melts a solid fixing agent Q and coats the melted solid fixing agent Q on a recording medium 2 to form a dye acceptor layer thereon.

In the ink jet recording apparatus shown in FIG. 26, the solid fixing agent Q is melted and coated on the recording medium 2 as follows: The solid fixing agent Q is placed in a solid fixing agent cassette 40 with a heater, and the solid fixing agent Q which is melted is discharged from the bottom of the solid fixing agent cassette 40 onto the recording medium 2 which is being fed in the direction indicated by the arrow. Then, the fixing agent Q on the recording medium 2 is uniformly squeezed into a dye acceptor layer X having a predetermined thickness by a squeezer 41. An image is thereafter printed on the dye acceptor layer X by a print head 1. The linear pressure of the squeezer 41, which depends on the viscosity of the solid fixing agent Q in a melted state, may be of about 0.5 kg/cm, for example.

While the ink jet recording apparatus according to various embodiments of the present invention have been described above, the present invention is not limited to the above embodiments, but may be modified in any of various other arrangements. For example, the ink jet recording apparatus may be arranged as a serial printer, a line head printer, or the like in the embodiment in which the fixing solution is expelled or sprayed from the nozzle or nozzles to form a dye acceptor layer on the recording medium 2, the embodiment in which the fixing solution is coated by a coating roller to form a dye acceptor layer on the recording medium 2, the embodiment in which the clay powder is applied to form a dye acceptor layer on the recording medium 2, the embodiment in which a dye acceptor layer is formed on the recording medium 2 by being thermally transferred from the ribbon, and the embodiment in which the solid fixing agent is melted and coated to form a dye acceptor layer on the recording medium 2.

When the fixing solution is expelled or sprayed from the nozzle or nozzles, the solvent of the fixing solution tends to evaporate, clogging the nozzle or nozzles. It is therefore preferable to mix a solvent having a low vapor pressure as a clogging inhibitor with the fixing solution. Such a solvent for use as a clogging inhibitor should preferably:

(1) be able to be mixed with another solvent and chemically stable in such another solvent;

(2) have a low vapor pressure (e.g., 0.11 nmHg or lower); and (3) be not frozen at low temperatures.

Such a solvent (clogging inhibitor) may be a nitrogen-containing solvent such as a glycol such as ethylene glycol, propylene glycol, diethylene glycol, triethylene glycol, tetraethylene glycol, polyethylene glycol, or glycerin, a glycol ether such as ethylene glycol monomethyl ether, ethylene glycol monoethyl ether, ethylene glycol monobutyl ether, methyl Carbitol, ethyl Carbitol, butyl Carbitol, ethyl Carbitol acetate, diethyl Carbitol, triethylene glycol monomethyl ether, triethylene glycol monoethyl ether, or propylene glycol monomethyl ether, an amide such as triethanolamine, formamide, or dimethyl formamide, or a pyrrolidone such as N-methyl-2-pyrrolidone.

The content of the clogging inhibitor, which differs in different circumstances, should generally be 3% or more of the total weight of the fixing solution, and preferably be in the range of from 3% to 90% of the total weight of the fixing solution.

In the embodiments, the dye acceptor layer is formed substantially at the same time that an image is printed on the recording medium 2. However, the dye acceptor layer may be formed in advance on the recording medium 2.

However, it is necessary to adjust the surface tension and viscosity of the fixing solution to be expelled or sprayed from the nozzle or nozzles differently in the case where the dye acceptor layer is formed substantially at the same time that an image is printed on the recording medium and in the case where the dye acceptor layer is formed in advance on the recording medium.

Specifically, if the dye acceptor layer is formed substantially at the same time that an image is printed on the recording medium, then a fixing solution with a solid content of a lower proportion, i.e., a fixing solution having a lower viscosity, is used than if the dye acceptor layer is formed in advance on the recording medium.

More specifically, if the dye acceptor layer is formed in advance on the recording medium, then a fixing solution composed, for example, of:

| | |
|---|---|
| intercalation compound: smectite | 150 g |
| binder resin: butyral | 100 g |
| solvent: ethanol | 900 g |

with a solid content having a proportion of 21.7% is used. If the dye acceptor layer is formed substantially at the same time that an image is printed on the recording medium, then a fixing solution composed, for example, of:

| | |
|---|---|
| intercalation compound: smectite | 75 g |
| binder resin: butyral | 25 g |
| glycol: ethylene glycol | 30 g |
| solvent: ethanol | 520 g |

with a solid content having a proportion of 15.4% is used.

At any rate, the same ink can be used.

The ink jet recording apparatus according to the present invention can form images of excellent water resistance and light resistance.

We claim:

1. An ink jet recording apparatus comprising:

an ink nozzle for expelling an ink toward a recording medium to form an image thereon; and dye acceptor layer forming means for forming on said recording medium a dye acceptor layer composed of an intercalation compound which fixes and holds a dye of said ink by way of an intercalation, wherein said dye acceptor layer forming means forms the dye acceptor layer by coating a fixing solution containing said intercalation compound on said recording medium with a coating roller.

2. An ink jet recording apparatus comprising:

an ink nozzle for expelling an ink toward a recording medium to form an image thereon; and dye acceptor layer forming means for forming on said recording medium a dye acceptor layer composed of an intercalation compound which fixes and holds a dye of said ink by way of an intercalation, wherein said dye acceptor layer forming means comprises means for electrically charging either a clay powder or a clay liquid composed of said intercalation compound and a thermoplastic resin and said recording medium to respective opposite polarities to cause said clay powder or said clay liquid respectively to be electrostatically attached to said recording medium, and means for heating and fixing said clay powder or said clay liquid to said recording medium.

3. An ink jet recording apparatus, comprising:

an ink nozzle for expelling an ink toward a recording medium to form an image thereon; and dye acceptor layer forming means for forming on said recording medium a dye acceptor layer composed of an intercalation compound which fixes and holds a dye of said ink by way of an intercalation, wherein said dye acceptor layer forming means comprises ribbon holding means for holding a ribbon composed of a base film and said dye receptor layer formed thereon, means for drawing said ribbon from said ribbon holding means, and heating means for thermally transferring the dye acceptor layer of the ribbon drawn from said ribbon holding means onto said recording medium.

4. An ink jet recording apparatus according to claim 3, further comprising a line print head for printing said recording medium with said dye acceptor layer formed thereon.

5. An ink jet recording apparatus according to claim 3, wherein said ribbon holding means comprises a ribbon cassette with said ribbon wound therein, and said heating means comprises a heater disposed in a cassette holder for holding said ribbon cassette.

6. An ink jet recording apparatus, comprising:

an ink nozzle for expelling an ink toward a recording medium to form an image thereon; and dye acceptor layer forming means for forming on said recording medium a dye acceptor layer composed of an intercalation compound which fixes and holds a dye of said ink by way of an intercalation, wherein said dye acceptor layer forming means melts a solid fixing agent composed of said intercalation compound and a wax, and coats the melted fixing agent on said recording medium.

* * * * *